US011690160B2

(12) United States Patent
Eden et al.

(10) Patent No.: US 11,690,160 B2
(45) Date of Patent: Jun. 27, 2023

(54) PLASMA PHOTONIC CRYSTALS WITH INTEGRATED PLASMONIC ARRAYS IN A MICROTUBULAR FRAME

(71) Applicant: The Board of Trustees of the University of Illinois, Urbana, IL (US)

(72) Inventors: J. Gary Eden, Mahomet, IL (US); Peng Sun, Savoy, IL (US); Wenyuan Chen, Champaign, IL (US); Yin Huang, Urbana, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 280 days.

(21) Appl. No.: 17/012,539

(22) Filed: Sep. 4, 2020

(65) Prior Publication Data

US 2021/0105887 A1 Apr. 8, 2021

Related U.S. Application Data

(60) Provisional application No. 62/898,112, filed on Sep. 10, 2019.

(51) Int. Cl.
*H05H 1/24* (2006.01)

(52) U.S. Cl.
CPC ..... *H05H 1/2406* (2013.01); *H05H 1/2431* (2021.05); *H05H 1/2437* (2021.05)

(58) Field of Classification Search
CPC .. H05H 1/2406; H05H 1/2437; H05H 1/2431; H01J 37/12; H01J 37/14; H01J 37/252
See application file for complete search history.

(56) References Cited

U.S. PATENT DOCUMENTS 8,957,572 B2 2/2015 Eden et al.
9,076,860 B1 * 7/2015 Lei ..... H01L 21/02076
(Continued)

FOREIGN PATENT DOCUMENTS

CN 109313154 B * 1/2022 ..... B41J 2/14072
CN 114062309 A * 2/2022
JP 2010077447 A * 4/2010

OTHER PUBLICATIONS

Guo, "Photonic band gap structures of obliquely incident electromagnetic wave propagation in a one-dimension absorptive plasma photonic crystal", Physics of Plasmas, 2009, pp. 1-6, vol. 16, 043508, American Institute of Physics.
(Continued)

*Primary Examiner* — Abdullah A Riyami
*Assistant Examiner* — Syed M Kaiser
(74) *Attorney, Agent, or Firm* — Greer, Burns & Crain, Ltd.; Steven P. Fallon

(57) ABSTRACT

The invention provides a microplasma photonic crystal for reflecting, transmitting and/or storing incident electromagnetic energy includes a periodic array of elongate microtubes confining microplasma therein and having a column-to-column spacing, average electron density and plasma column diameter selected to produce a photonic response to the incident electromagnetic energy entailing the increase or suppression of crystal resonances and/or shifting the frequency of the resonances. The crystal also includes electrodes for stimulating microplasma the elongated microtubes Electromagnetic energy can be interacted with the periodic array of microplasma to reflect, transmit and/or trap the incident electromagnetic energy.

22 Claims, 15 Drawing Sheets

(56) References Cited

U.S. PATENT DOCUMENTS

| | | | | |
|---|---|---|---|---|
| 10,088,452 | B2 * | 10/2018 | Villani, Jr. | G01N 27/82 |
| 10,548,210 | B2 * | 1/2020 | Eden | H05H 1/2406 |
| 10,755,922 | B2 * | 8/2020 | Blanquart | H01L 21/76229 |
| 10,804,098 | B2 * | 10/2020 | Raisanen | H01L 21/0228 |
| 11,447,861 | B2 * | 9/2022 | Maes | C23C 16/52 |
| 2002/0159733 | A1 * | 10/2002 | Flory | H01P 1/2005 385/39 |
| 2004/0104682 | A1 * | 6/2004 | Horsky | H01L 21/26513 315/111.81 |
| 2010/0062182 | A1 * | 3/2010 | Arai | G02F 1/1309 118/733 |
| 2014/0131769 | A1 * | 5/2014 | Park | H01L 29/1054 257/190 |
| 2014/0149952 | A1 * | 5/2014 | Salama | H01L 21/02697 438/666 |
| 2016/0180960 | A1 * | 6/2016 | Lee | G06F 13/1673 365/225.7 |
| 2016/0334396 | A1 * | 11/2016 | Cheng | G01N 33/54326 |
| 2017/0207523 | A1 * | 7/2017 | Eden | H05H 1/2406 |
| 2018/0331255 | A1 * | 11/2018 | Grundmann | H01L 33/0025 |
| 2019/0129093 | A1 * | 5/2019 | Li | G02B 6/02076 |

OTHER PUBLICATIONS

Sakai et al., "Interaction and control of millimetre-waves with microplasma arrays", Plasma Physics and Controlled Fusion, Nov. 9, 2005, pp. B617-B627, vol. 47, Institute of Physics Publishing.

Sakai et al., "Photonic bands in two-dimensional microplasma arrays. I. Theoretical derivation of band structures of electromagnetic waves", Journal of Applied Physics, Apr. 6, 2007, pp. 1-9, vol. 101, 073304, American Institute of Physics.

Sakai et al., "Plasmas as metamaterials: a review", Plasma Sources Science and Technology, Jan. 31, 2012, pp. 1-18, vol. 21, 013001, Institute of Physics.

* cited by examiner

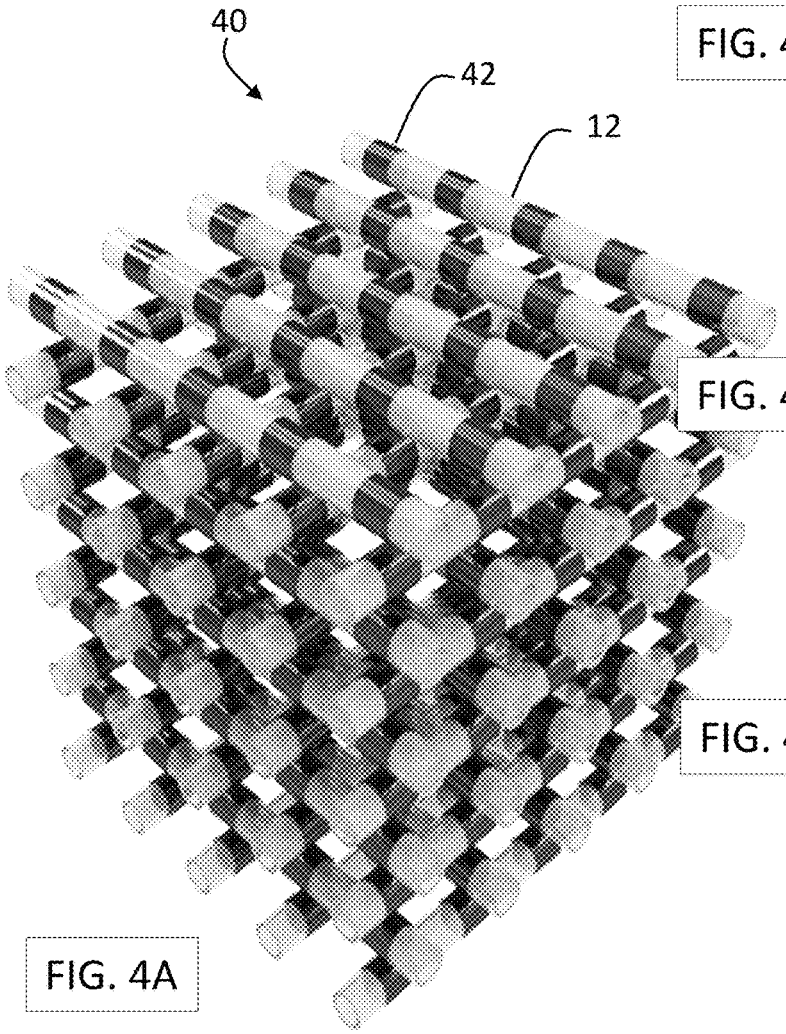
FIG. 4A
FIG. 4B
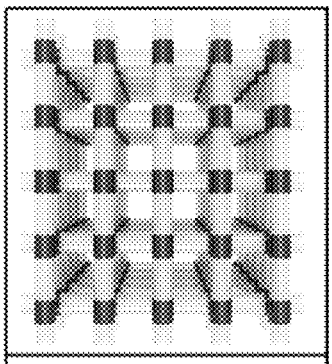
FIG. 4C
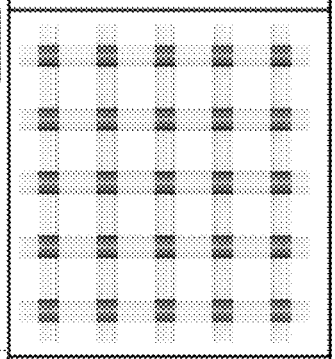
FIG. 4D
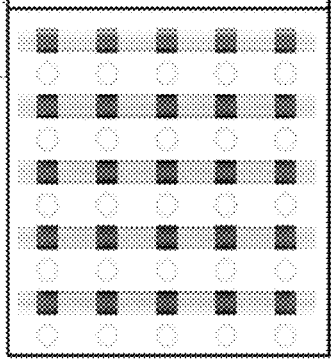

FIG. 5A
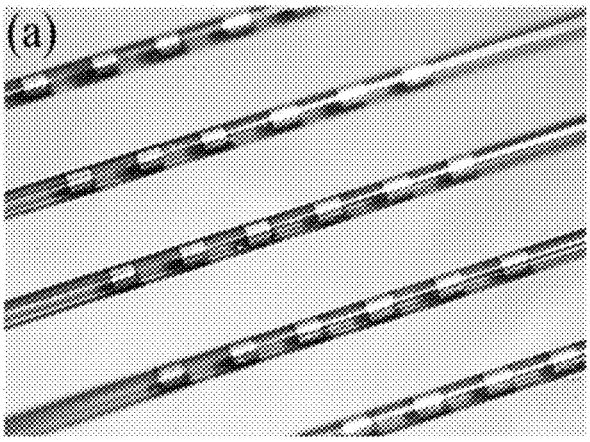
FIG. 5B
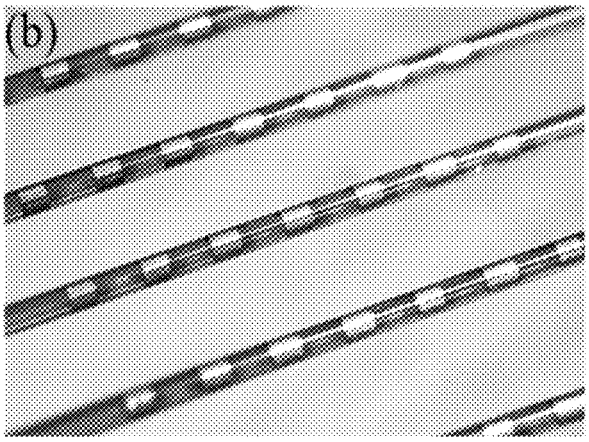
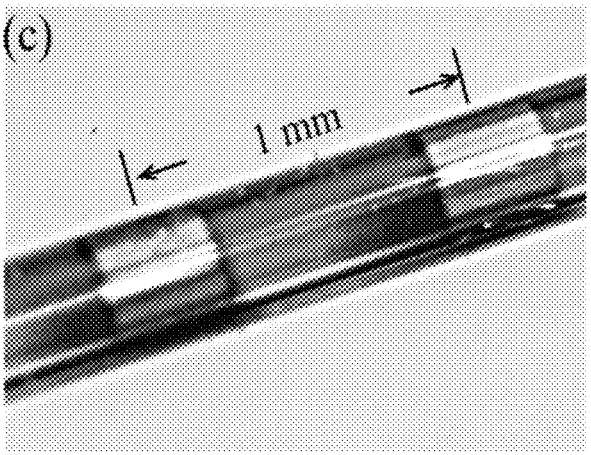
FIG. 5C
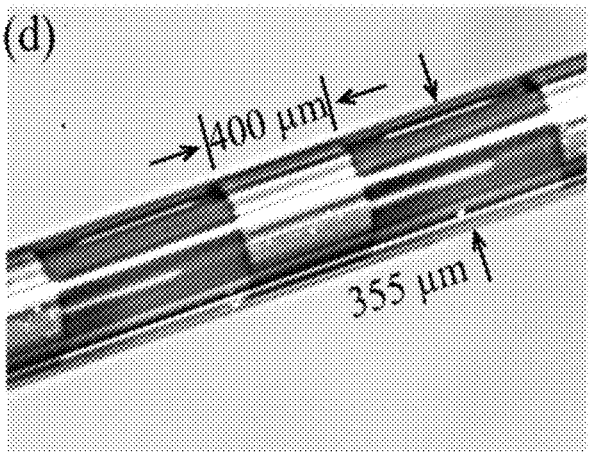
FIG. 5D

FIG. 8A
FIG. 8B
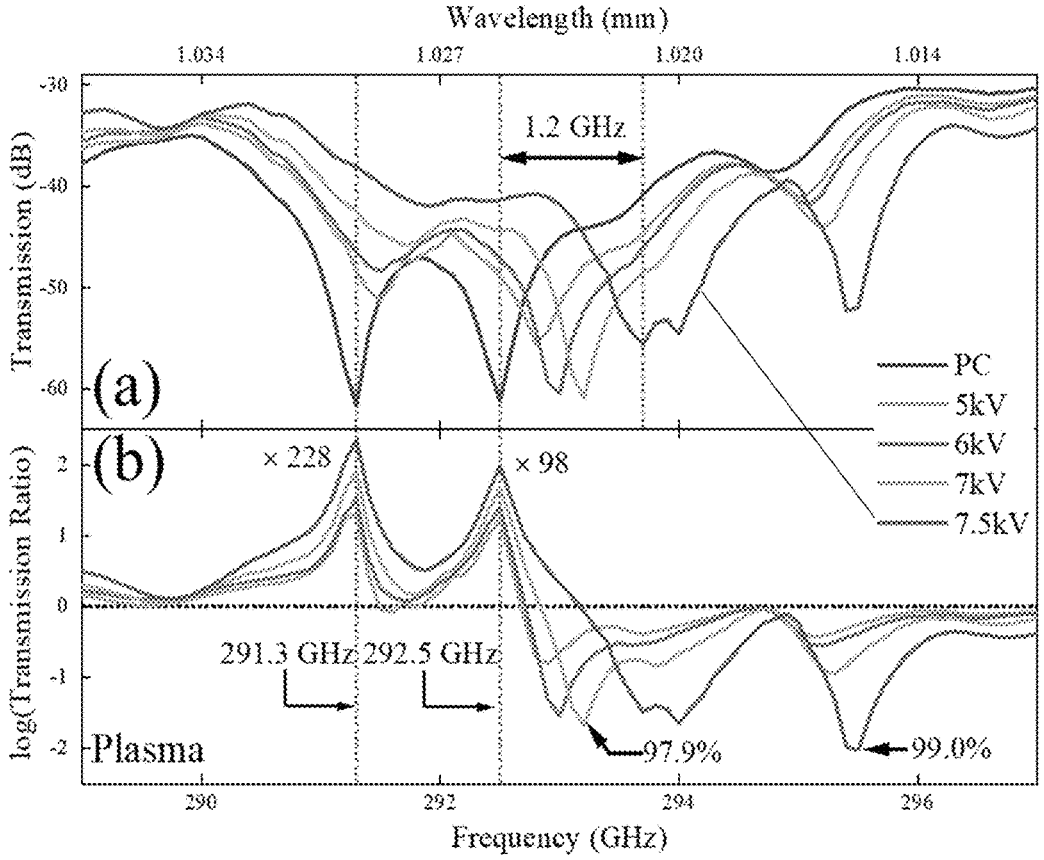
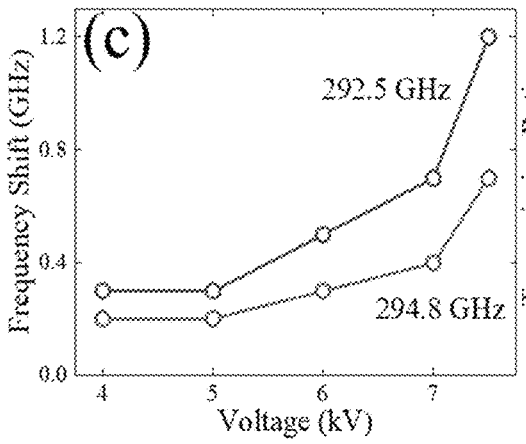
FIG. 8C
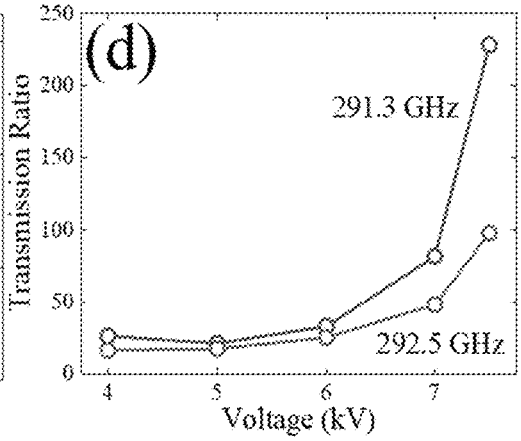
FIG. 8D

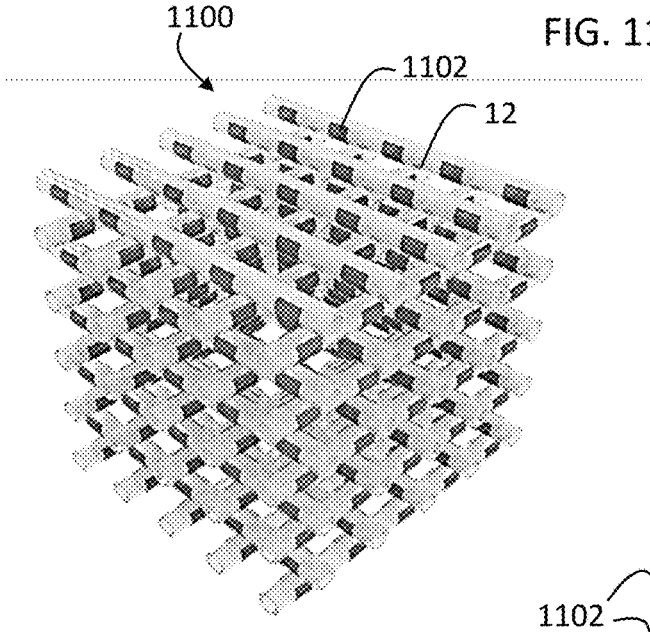
FIG. 11A
FIG. 11B
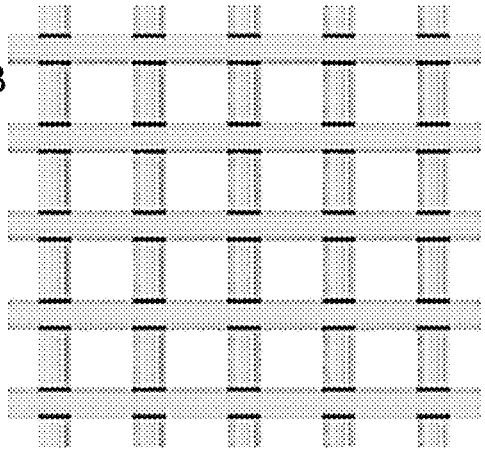
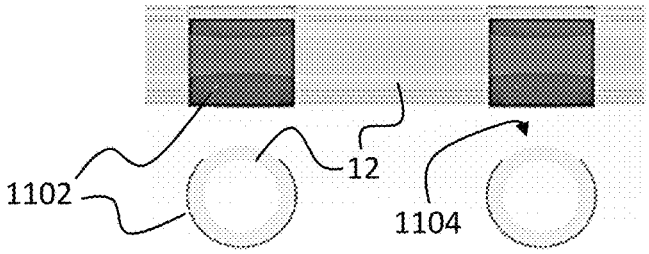
FIG. 11C
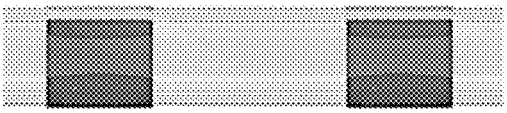

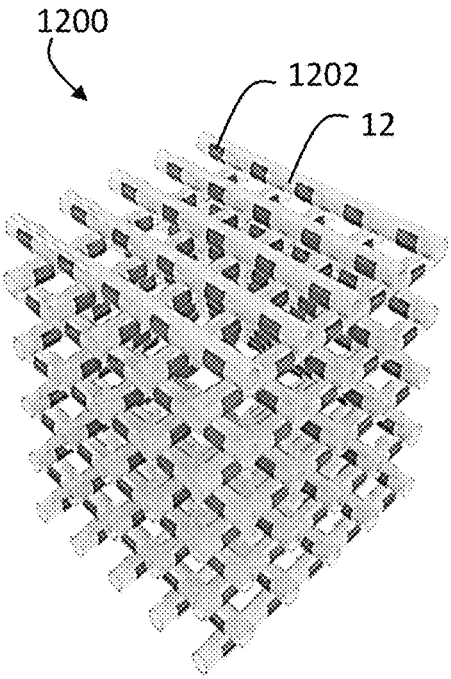
FIG. 12A
FIG. 12B
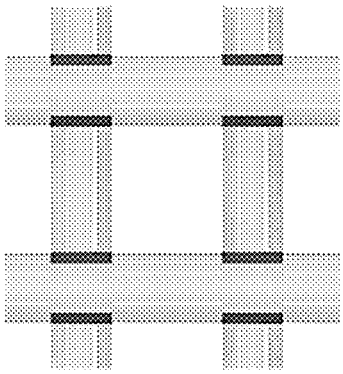
FIG. 12C
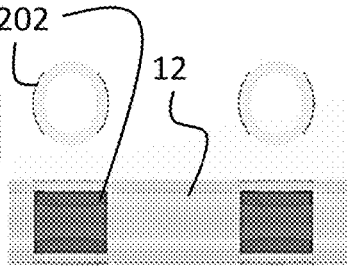
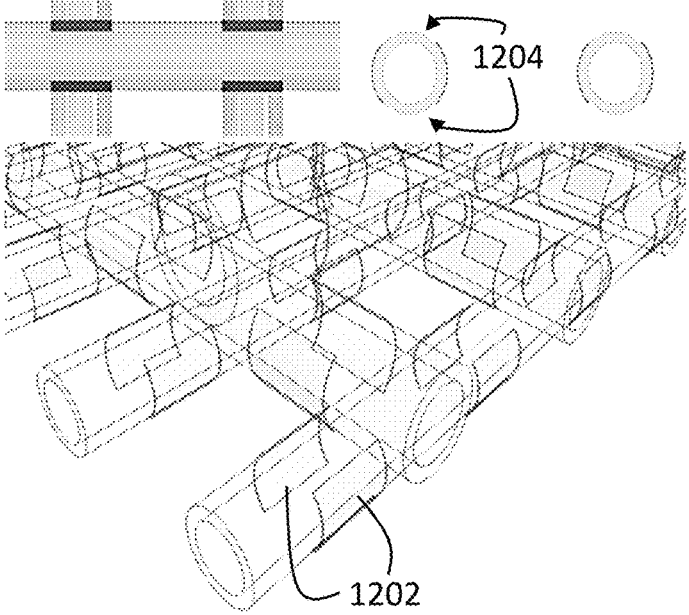
FIG. 12D

PLASMA PHOTONIC CRYSTALS WITH INTEGRATED PLASMONIC ARRAYS IN A MICROTUBULAR FRAME

PRIORITY CLAIM AND REFERENCE TO RELATED APPLICATION

The application claims priority under 35 U.S.C. § 119 and all applicable statutes from prior U.S. provisional application Ser. No. 62/898,112, which was filed Sep. 10, 2019.

STATEMENT OF GOVERNMENT INTEREST

This invention was made with government support under grant no. FA9550-14-1-0002 awarded by the U.S. Air Force Office of Scientific Research. The government has certain rights in the invention.

FIELD

Fields of the invention include electromagnetic devices, including resonators, filters, phase shifters, beamsplitters, routers, two- and three-dimensional photonic crystals, and microplasma devices. Example applications include the redirecting (reflecting) or storing and release of electromagnetic energy, including electromagnetic energy in the microwave, mm-wave, or THz spectral regions (~1 GHz-10 THz). Specific examples of devices enabled by the invention include bandpass filters, beamsplitters or routers, attenuators, reflectors, resonators, and phase shifters for frequencies up to and beyond 10 THz. Additional applications include radar, radio astronomy and spectroscopy, remote sensing, molecular detection, energy storage and transmission, and wireless telecommunications, all of which can involve the use of a portion of the electromagnetic spectrum and the reflection, phase-shifting, transmission, absorption, or temporary storage of electromagnetic energy by methods and devices of the invention.

BACKGROUND

Two- and three-dimensional photonic crystals were proposed by Eli Yablonovich, but the underlying concept of modulating the refractive index of a dielectric structure on a periodic basis appeared earlier in optical devices such as the Bragg grating and multilayer dielectric mirrors. At the heart of the latter, for example, is a multilayer stack of thin films in which the refractive index is alternated between two disparate values. Performance is also enhanced if the thickness of each film in the stack is an integral multiple of $\lambda/4$, where $\lambda$ is the wavelength of interest. Similarly, photonic crystals are characterized by varying the index of refraction along at least one spatial coordinate in a spatially-periodic manner Such crystals have been applied in numerous contexts, including optical communications, to achieve effective control over the phase and amplitude of electromagnetic waves. One drawback of conventional photonic crystals is that the properties of the crystal are fixed and not readily altered. That is, the crystal is static and the electromagnetic properties of the crystal, including its transmission and reflection spectra, cannot be quickly varied with time.

Low temperature-plasma has been proposed previously as a dielectric medium suitable for photonic crystals. See, Sakai, O., Sakaguchi, T., Ito, Y. & Tachibana, K., "Interaction and control of millimetre-waves with microplasma arrays," Plasma Phys. Control. Fusion 47, B617-B627 (2005); Sakai, O. & Tachibana, K., "Plasmas as metamaterials: a review," Plasma Sources Sci. Technol. 21, 013001 (2012); Sakai, O., Sakaguchi, T. & Tachibana, K., "Photonic bands in two-dimensional microplasma arrays," I. Theoretical derivation of band structures of electromagnetic waves. *J. Appl. Phys.* 101, 073304 (2007). Sakai et al. generated columnar plasmas ~2 mm in diameter in a periodic, two-dimensional structure that had an overall area of 44 mm×44 mm, but converting this structure into three dimensions is problematic because of the electrode configuration and structure geometry. Although Sakai et al. experimentally demonstrated photonic crystals comprising two-dimensional (2D) arrays of plasmas having electron densities ($n_e$) in the range of $10^{11}$ to $10^{13}$ $cm^{-3}$, several factors led to the observation of small attenuations and spectrally-broad features. The first of these concerns the non-uniform diameter of the columnar plasmas (nominally 2 mm in diameter), the overlap between (i.e., partial blending of) adjacent plasmas, and the limited precision in the positioning of the plasmas. All of these factors limit the electromagnetic performance of the crystals and, specifically, the Q of the crystal resonances and their tunability. A one-dimensional plasma photonic crystal was also proposed in Guo, B. "Photonic band gap structures of obliquely incident electromagnetic wave propagation in a one-dimension absorptive plasma photonic crystal". Phys. Plasmas 16, 043508 (2009)

Tachibana and colleagues also employed 2D microplasma arrays that produced spatially-disperse plasmas (i.e., not uniform in diameter). Attenuation of 60 GHz microwave signals was observed in these experiments but the magnitude of the suppression was modest. Guo proposed a one-dimensional design for a plasma-based photonic crystal that similarly is not readily extendable to two or three dimensions. The weak attenuation of incident electromagnetic energy, and the restriction of previous plasma photonic crystal designs to one or two dimensions suggest that the prior art does not offer structures capable of competing with photonic crystals fabricated from solids, or for capturing the inherent advantages that plasma-based photonic crystals have with respect to tunability and reconfigurability.

An advance was recently provided by Eden et al., U.S. Pat. No. 10,548,210, entitled Control of Electromagnetic Energy with Spatially Periodic Microplasma Devices, and incorporated by reference herein. This patent provides arrays of discrete microplasmas generated within a volume that precisely defines the geometry of each microplasma while avoiding any interfering structures, such as electrodes. That is, all electrodes and electrical connections are situated outside the crystal's active volume. This design provides for arrays of microcolumnar plasmas, for example, to be realized in which each cylindrical plasma is uniform in cross-section along its entire length, thereby avoiding any overlap between adjacent, parallel microplasmas. The volume to be filled by each microplasma is defined by microchannels formed within a small polymer block that also makes provision for an electrode array near the perimeter of the structure for the purpose of generating the microplasmas. Such 2D and 3D photonic crystal devices exhibit resonances in the microwave and millimeter wave regions that are tunable because the properties of the microplasmas (such as their electron densities) are readily adjustable through the imposed voltage. This family of devices offers inexpensive fabrication, and provides the option to fill a portion of the microplasma volumes (defined within the polymer block) with metal or a dielectric, for example, so as to yield an electromagnetic response different from that of an array comprising only microplasmas. The devices of the '210 Patent do, however, exhibit significant insertion loss which is introduced by the polymer enclosure for the photonic crystal. For example, the attenuation of the polymer structure in the spectral region above 100 GHz can be at least 30 dB for an 8-layer photonic crystal device. This insertion loss can be an impediment to the application of these devices in 5G communications systems, for example. Another limitation is that the volume between microplasmas is occupied by polymer (or other material from which the array enclosure is fabricated), thus precluding the insertion of electromagnetically-active materials or structures (other than the plasma crystal itself) between the microchannels fabricated in the polymer block (enclosure). In addition, the inability to surround each microplasma, or groups of microplasmas, with other electromagnetically-active media or structures limits the utility of the '210 Patent for communications and sensor applications.

SUMMARY OF THE INVENTION

Preferred embodiments include a method of reflecting, transmitting, storing, or altering the phase of incident electromagnetic energy. The method includes generating a periodic array of microplasmas in an array of microtubes, wherein at last a plurality of the microtubes each separately confine microplasma therein, wherein the array has a spacing and average electron density selected to form a photonic crystal and produce a photonic response to the incident electromagnetic energy. The method also includes interacting the incident electromagnetic energy with the periodic array of microplasmas to reflect, transmit and/or trap the incident electromagnetic energy.

A microplasma photonic crystal for reflecting, transmitting and/or storing incident electromagnetic energy includes a periodic array of elongate microtubes confining microplasma therein and having a column-to-column spacing, average electron density, and plasma column diameter selected to produce a photonic response to the incident electromagnetic energy entailing the increase or suppression of crystal resonances and/or shifting the frequency of the resonances. The crystal also includes electrodes for stimulating microplasma the elongated microtubes.

BRIEF DESCRIPTION OF THE DRAWINGS

FIGS. 3A, 3C and 3E are optical micrographs prior to generation of plasma and FIGS. 3B, 3D and 3F are respective micrographs during operation;

FIGS. 4A-4D illustrate a preferred three-dimensional microplasma photonic crystal consistent with FIGS. 1A-1C that includes a pattern of metal bands that can interact with the photonic response of the crystal and can be arranged so as to provide both a plasmonic response and a periodic capacitance;

FIGS. 5A-5D are photographs of fabricated microtubes prior to assembly of an experimental microplasma photonic device in accordance with FIGS. 4A-4D;

FIGS. 8A-8D include spectral data illustrating the influence of the voltage driving the plasma microcolumns on the resonances of the experimental microtube/metal band crystals of FIG. 2 or 6A-6E;

FIGS. 11A-11C illustrate a preferred three-dimensional microplasma photonic crystal consistent with FIGS. 1A-1C that includes a pattern of split-ring metal film resonators on the microtubes;

FIGS. 12A-12D illustrate a preferred three-dimensional microplasma photonic crystal consistent with FIGS. 1A-1C that includes a pattern of double metal-ring resonators on the microtubes;

DETAILED DESCRIPTION OF THE PREFERRED EMBODIMENTS

Figure 1A:
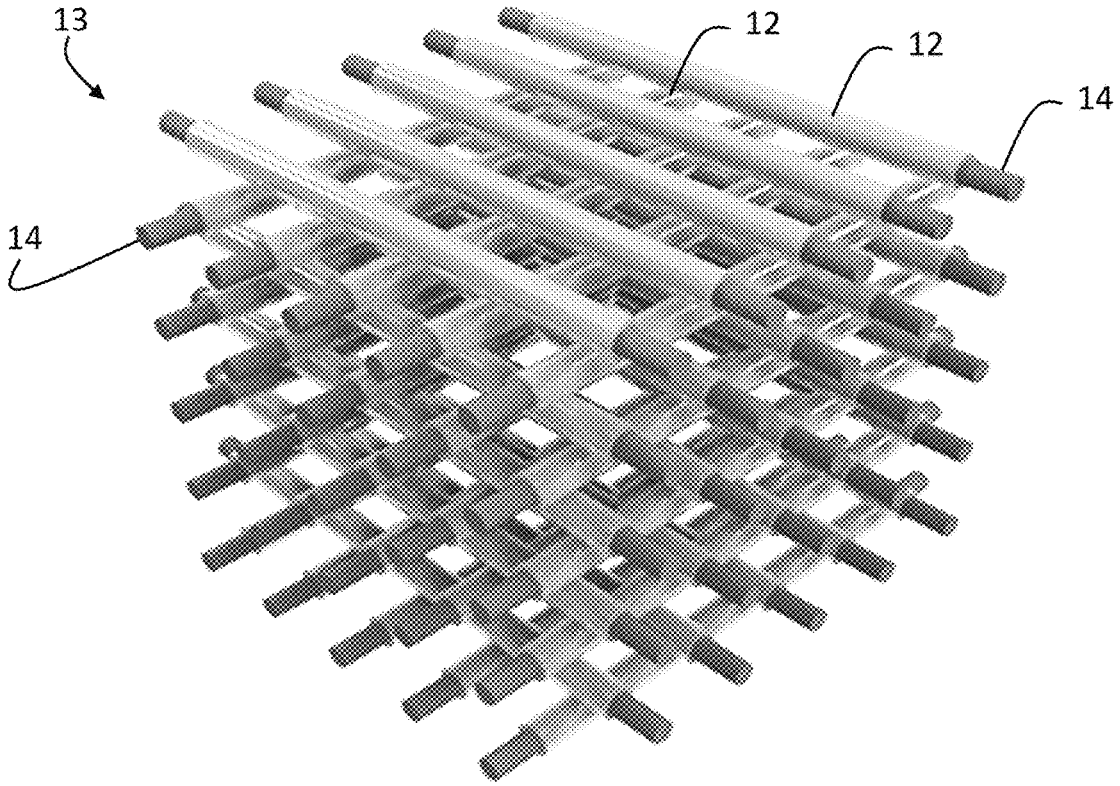
FIGS. 1A-1C are respective perspective, top schematic, and side schematic views of a preferred three-dimensional microplasma photonic crystal according to a preferred embodiment of the invention.

Preferred embodiments provide a microplasma photonic crystal device that is capable of limiting insertion losses and incorporating electromagnetically-active materials or structures among the microplasmas in the periodic crystal structure of the device. Prototypes have been constructed that include complex, three-dimensional (3D) structures of free-standing arrays of polyimide microtubes. The microtubes are assembled into a 3D-printed polymer scaffold supported by a holder/mold situated around the perimeter of the scaffold, which results in structures that are dimensionally precise without distorting the diameter, or altering the position, of the individual microtubes. The elimination of the bulk polymer enclosure of U.S. Pat. No. 10,548,210 reduces the insertion loss of the crystal by tens of dB.

In a preferred embodiment, portions of the outer wall of the microtubes are partially coated, for example with a metal. The coating of the microtubes with specific metals such as gold and silver, in particular, introduces plasmonic spectral modes that interact with the photonic resonances of the periodic crystal structure. The metal coatings can be spaced periodically along the length of the microtubes, thereby producing a Bragg structure on each microtube. Furthermore, the gaps between the metal coatings in adjacent rows of microtubes can be designed over a wide range of gap values, thereby changing the capacitance between the metal coating arrays and altering the overall spectral response of the crystal in a predictable manner. The crystals of this embodiment, therefore, consist of three periodic lattices: 1) the periodic array of microtubes; 2) the microplasmas themselves (or other material within the tubes such as metal or dielectric), and 3) the metal plasmonic structures. The latter can also be configured so as to be periodic in all three spatial dimensions. Finally, the interstices (gaps) between the microtubes in the crystal can now be filled with a sample gas or liquid that absorbs in the mm-wave or terahertz region. In this way, the crystal structure can serve as a sensor of (for example) atmospheric pollutant gases. Alternatively, the "gaps" or open spaces in the crystal or between one or more microtubes can be filled with an electromagnetically-active gas, solid or liquid such as a ferrofluid. Ferrofluids or periodically-arranged magnetic materials such as nanoparticles or thin microdisks are of interest because the microplasma arrays can be magnetized, thereby enabling further versatility in controlling the properties of electromagnetic waves processed, or energy stored, by the crystal. This can benefit the spectral processing of communications or sensing signals in the microwave, mm-wave, or THz spectral regions.

Crystals of the invention can have baseline (background) attenuations less than 10 dB, as opposed to the value of 30 dB characteristic of the prior design in Eden et al. (U.S. Pat. No. 10,548,210). This represents a factor of at least 100 improvement in the insertion loss of the devices.

The new crystals of the invention permit the application of metal and/or dielectric coatings onto some or all of the microtubes before they are assembled into the form of a crystal, which is not possible with the crystals of Eden et al. (U.S. Pat. No. 10,548,210). The metal or dielectric films can also be patterned into one or more arrays such that the array periodicity is transverse or longitudinal with respect to the propagation of an electromagnetic wave through the microplasma photonic crystal. One result of this new capability, already observed in the testing of prototypes, is that these microplasma photonic crystals have the ability to introduce or completely suppress attenuation resonances according to a design, or through the selective activation of plasma-filled microtubes of the crystals. One or more microcolumn plasmas may be selectively activated (addressed) as may entire planar (or cylindrical) arrays of microplasmas. Selective activation allows for the transmission of certain frequencies by the crystal at one moment, and others in the next. Known as frequency multiplexing, this electronic function is critical to communications systems and has not been available with mm-wave and THz devices in the past. In addition, we have demonstrated that the introduction of plasma into specific microtubes in the crystal has the effect of "cancelling" or reversing an attenuation resonance. Thus, the plasmas are able to induce an electromagnetic transparency in the crystal at specific wavelengths (frequencies).

In addition to new features and advantages, crystals of the present invention provide the capabilities provided by Eden et al. (U.S. Pat. No. 10,548,210), which is incorporated by reference herein, including an ability to control incident electromagnetic energy. Additionally, crystals of the invention are capable of selectively reflecting, transmitting, and temporarily storing incident electromagnetic energy within predetermined wavelength ranges. With the low-loss crystals introduced by the present invention, it is also now possible to extract energy from a large array of microplasma photonic crystals disposed on a surface that is flat, spherical, or parabolic in shape. In a manner similar to the operation of a regenerative amplifier, energy can be supplied to the array from a steerable source, over a period of time that is long compared to the time during which energy is emitted by the array. The radiation from the array can be phased by the spectral properties of each crystal which, in turn, is dictated by the physical structure of each crystal and the time-varying voltage applied to the crystals.

Preferred embodiments of the invention will now be discussed with respect to the drawings and with respect to experimental devices. The drawings may include schematic representations, which will be understood by artisans in view of the general knowledge in the art and the description that follows. Features may be exaggerated in the drawings for emphasis, and features may not be to scale.

Figure 1B:
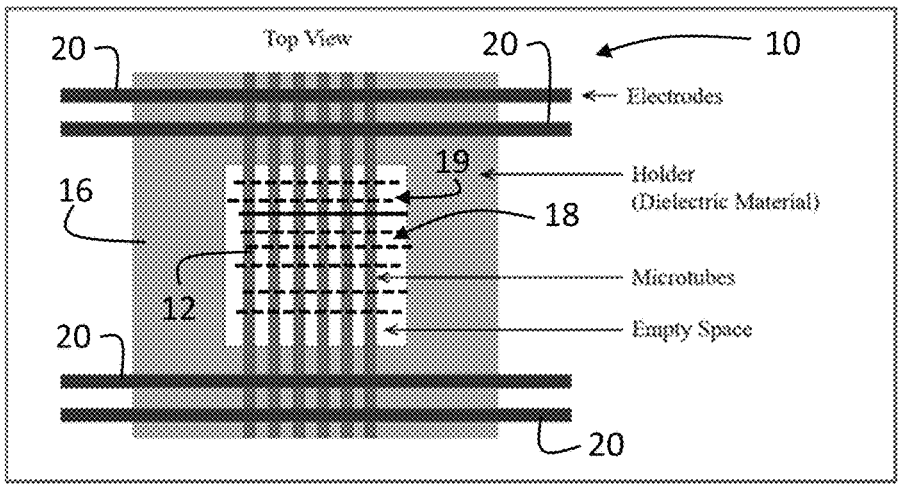
Figure 1C:
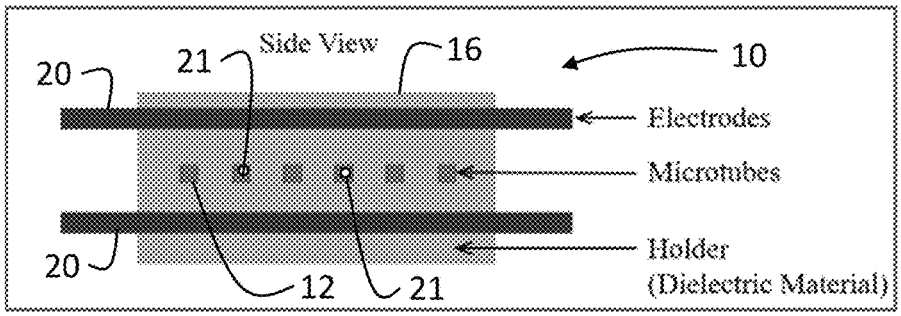

FIGS. 1A-1C illustrate a preferred embodiment microplasma photonic crystal 10. The microplasma photonic crystal 10 includes a geometric assembly of microtubes 12, with the entire assembly being referred to as a scaffold 13. Each microtube confines a microplasma 14 selectively generated therein. As shown in FIGS. 1B and 1C, a holder or mold 16 with an empty volume 18 is situated around the scaffold 13, supporting the microtube assembly, as well as electrodes 20 that are arranged to stimulate plasma generation in the microtubes 12. The volume 18 can be in the range of less than one cubic centimeter to more than 1000 cubic centimeters. Each of the microtubes 120 can be formed, for example, from a polymer such as polyimide, and such tubes are available commercially. The microtubes can have an outer diameter in the range of 20-800 micrometers and an inner diameter in the range of 5-500 micrometers. The geometry of the crystalline microtube scaffold 13 illustrated in FIG. 1A is known as a "woodpile" configuration, and at least one of the microtubes 12 contains a plasma medium that is excited when a time-varying voltage is applied to the electrodes 20. The electrodes 20 are preferably fabricated as a plurality of pairs, also forming a three-dimensional pattern so as to address individual microtubes 12 or entire arrays of microtubes so as to generate microcolumn plasmas in planar arrays comprising parallel microcolumns. Although (for illustrative purposes) plasma is shown as occupying all of the microtubes 12 in FIG. 1A, power can be supplied (if desired) to selected ones of electrode pairs, thereby causing plasma to be generated only in selected microtubes, or groups of microtubes lying within a specific plane, for example. Additionally, electrodes 20 can be arranged to excite single microtubes 12 or entire planes of parallel microtubes 12.

The scaffold 13 is to have a spacing and average electron density selected to form a photonic crystal and produce a photonic response to the incident electromagnetic energy. Setting these parameters is discussed in Eden et al. (U.S. Pat. No. 10,548,210) and the scientific literature. Generally, the plasma photonic crystals described here are based on spatially-periodic arrays of microplasmas or metals, dielectrics, and/or magnetic materials. The periodic variation of the refractive index along at least one spatial coordinate is a signature of all photonic crystals, of which the multilayer dielectric mirror is perhaps the best (albeit one-dimensional) example. The lattice constant (i.e., the spacing between "layers" of the crystal) determines the approximate frequency or wavelength region in which the crystal will function. If the lattice constant along a specific crystalline axis is denoted d, then $d=\lambda/2$, where $\lambda$ is known as the Bragg wavelength for the crystal along that axis. For the crystal embodiments described here, d is set to 1.0 mm along the longitudinal axis of the crystal, thus setting the Bragg wavelength to 150 GHz. For convenience, the microtube spacing in the planes transverse to the longitudinal axis is also set to 1.0 mm. However, it should be understood that these parameters can be varied at will so as to alter the range in operating wavelength and spectral characteristics of the transmission spectrum, for example. Speaking qualitatively, a plasma photonic crystal can be expected to show strong response over the wavelength region extending from double the Bragg wavelength to ½ the Bragg wavelength. For d=1.0 mm, this range in frequency would extend from ~75 GHz to 300 GHz and, indeed, we observe crystal resonances, and a strong impact of the microplasmas on these resonances, for frequencies down to 120 GHz and up to 300 GHz. The capabilities of the diagnostic equipment available to us precluded studies at frequencies below 120 GHz. The above discussion presumes that the electron number density $n_e$ is sufficient for the microplasmas to significantly impact the resonances produced by the polymer microtubes, the plasmonic array, or arrays of metal or dielectric-filled microtubes that might be established. That is, if the electron density is insufficient, then igniting the plasmas will not, for example, significantly blue-shift the resonances as shown in FIGS. 8A-8C. Experience and theory suggest that the time-averaged electron density should be on the order of $10^{10}$-$10^{11}$ $cm^{-3}$ if the crystal is to function in the 1-10 GHz region. However, for frequencies above 100 GHz, electron densities above $10^{13}$ $cm^{-3}$ and, preferably, above $10^{14}$ $cm^{-3}$ are required. For the pulsed voltages specified in FIG. 8A, time-averaged electron densities above $10^{14}$ $cm^{-3}$ are generated in argon gas when flowed through the microtube structure of FIGS. 1A-1C.

In FIGS. 1B and 1C, for simplicity, only one planar array of microtubes 12 is shown. The holder 16 is preferably a 3D-printed polymer holder (or frame) that serves to fix the position of each microtube 12 relative to others in the same plane as well as those in different planes. Notice that the holder 16 defines the perimeter of the active region of the crystal because it also accommodates the arrays of electrodes 20. That is, each microtube 12 is situated between two electrodes 20 that are embedded in the holder 16 and extend the full length of the holder 16 so as to make electrical contact with each end of the microtubes 12. The termination of an electrical contact to one end of a microtube can be as simple as a pin inserted into the microtube. Those skilled in the art of plasmas will recognize that other geometries and structures for the electrode termination, such as cylindrical, hollow electrodes or field emission electrodes, will also be of value. Because the microtubes 12 are fixed in position at each end by the holder 16, the microtubes 12 are suspended within the volume 18 (the active region or aperture of the crystal) that is free of electrodes 12 which would otherwise perturb the spectral response of the crystal. Viewed another way, the holder 16 defines the precision with which the microtubes 12 are arranged but it also serves as a conduit for electrical connections and provides microports through which the plasma medium (typically a gas or vapor or combination thereof) may be delivered to the microtubes 12. Also, the electrodes 20 are arranged so as to allow microplasma to be generated in each microtube 12 independently from all other microtubes 12. That is, the microplasmas in the microplasma photonic crystal 10 can be addressed separately.

As an alternative to electrodes 20 that are separate from the microtubes 12, the electrodes 20 can also be integrated into selected ones of the microtubes 12. For example, alternate rows or other patterns of the microtubes can be filled with metal and serve as electrodes to excite plasma in proximate microtubes that contain a plasma medium. As another option, selected ones of the microtubes 12 can be filled with dielectric, with the goal of having the behavior of the microplasma photonic crystal 10 controlled by remaining microtubes that contain plasma medium. Filling certain microtubes with dielectric and others with metal or plasma is primarily of value, however, for controlling the electromagnetic response (i.e., transmission and reflectance spectra) of the plasma/metal/dielectric crystal. As yet another option, the microtubes 12 can be coated with metal or dielectric, or selected groups of microtubes can be coated with metal or a dielectric.

The isometric projection of FIG. 1A represents microtubes fabricated from a polymer such as polyimide and arranged into the desired 3D geometry (known as a scaffold) such as the woodpile configuration of FIGS. 1A-1B. The microtubes may also be fabricated from other polymers such as ABS or CR39, as well as other materials such as glass or silica. FIG. 1A present an example geometry, but other crystal geometries, will also serve well.

In order to achieve the dimensional precision necessary for reproducible and optimal performance of the microplasma photonic crystal 10, the assembly of the polymer holder 16 preferably takes place within a mold that is produced by computer design and 3D stereolithography. The assembly of the desired microtube lattice 13 (i.e., desired geometric arrangement) within this microfabricated holder 16 ensures that the microtubes can be positioned to within a precision of +/−10 μm. Furthermore, the low-temperature plasma produced within the microtubes 12 has a uniform diameter along the entire length of the microtube 12, which confine the plasma. A wide variety of geometries can be made with precision via computer design and 3D stereolithography.

The positional accuracy with which the microplasma photonic crystal 10 is assembled can translate directly into spectral resonances of greater magnitude and narrower bandwidths. In experimental devices, the outer diameters of the polyimide microtubes are typically in the 20-800 μm interval whereas the inner diameters can range from 5 to 500 μm.

In addition, one has the option of filling all or a portion of the "open volume" in these crystals with a gas, liquid, or solid, thus allowing for the microplasma photonic crystal to act as a sensor. For example, if the active volume 18 is filled with a molecular gas 19 (FIG. 1B) having a resonance in the spectral region for which the crystal is designed, the molecule can be detected easily with the appropriate microwave, mm-wave, or THz electronics by monitoring the transmission of the crystal as the frequency of the incoming microwave-THz signal is scanned. This arrangement is well-suited for several applications, including the detection of atmospheric pollutants in industrial smokestacks or in urban areas with congested traffic. Furthermore, specific microtubes in the microplasma photonic crystal lattice structure can be filled with a gas, liquid, or solid to be probed electromagnetically. Alternatively, one or more microtubes may be filled with magnetically-active material 21 (FIG. 1C) such as a ferrofluid, or magnetic materials such as nanoparticles or arrays of thin discs arranged along the length of the tube. In short, the versatility of the crystalline lattices of the invention allow for sensors to be realized and, secondly, microplasma photonic crystals with magnetized plasma to be constructed. The latter will exhibit spectral characteristics to be obtained that are not achievable with non-magnetized plasma.

Figure 2:
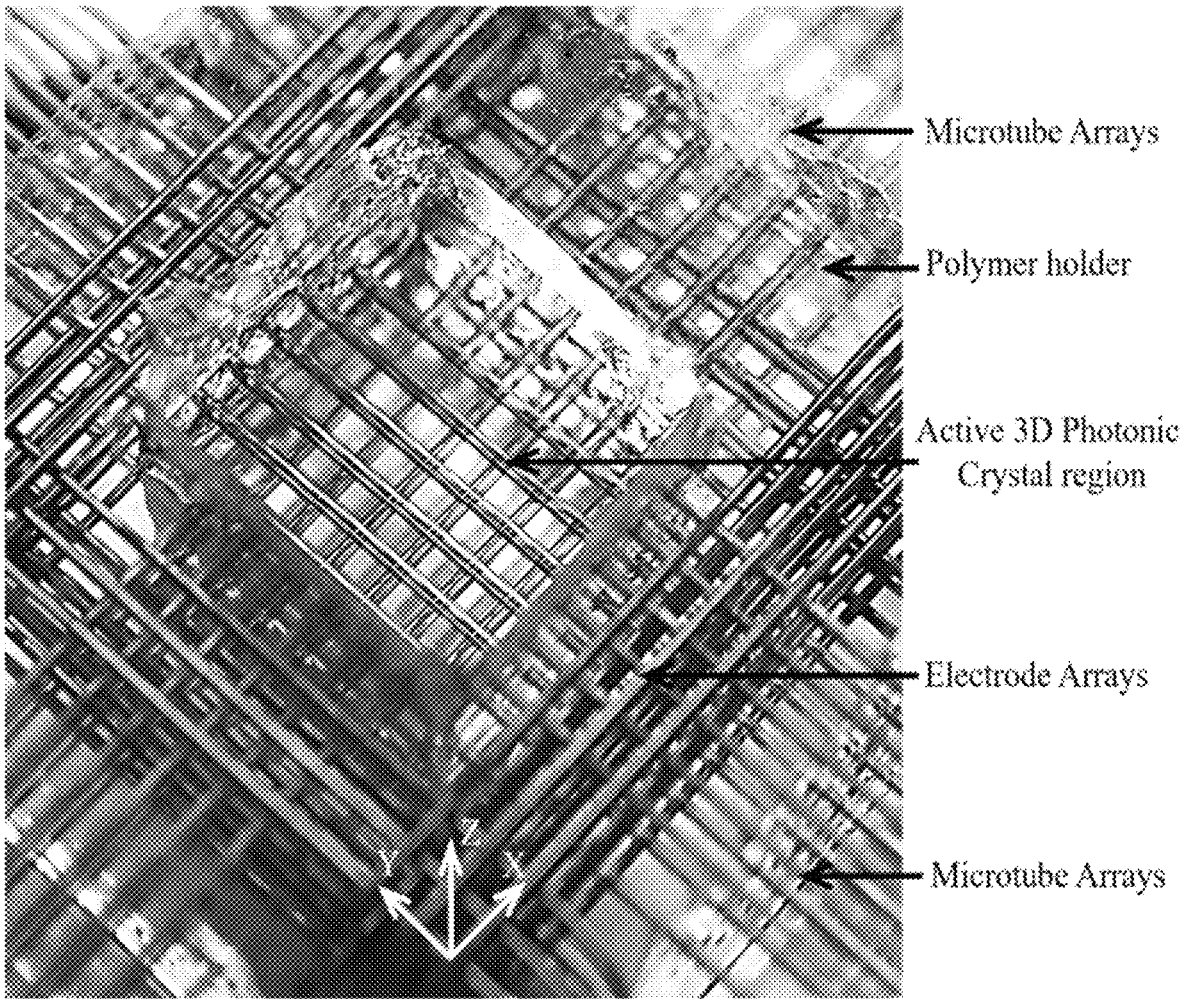
FIG. 2 is a photograph of an experimental microplasma photonic crystal in accordance with the FIGS. 1A-1C preferred embodiment.

FIG. 2 is a photograph of a fabricated PPC (having the structure of FIGS. 1A-1C) and its electrical connections. As noted earlier, each of the microtubes in the woodpile structure crystal is held in position by a polymer holder that lies outside the central (active) portion of the crystal. Although the mold material is a polymer for the crystals presented here, other dielectric materials, such as alumina ($Al_2O_3$), are also suitable. Alumina frames, for example, can be fabricated from nano- or micro-particle powder by molding and firing the material. Polymer holders can be readily fabricated by 3D printing. At the perimeter of the crystal in FIG. 2, one can see the electrode arrays serving to power the microplasmas generated within the microtubes.

Figures 3A, 3B, 3C, 3D, 3E, 3F:
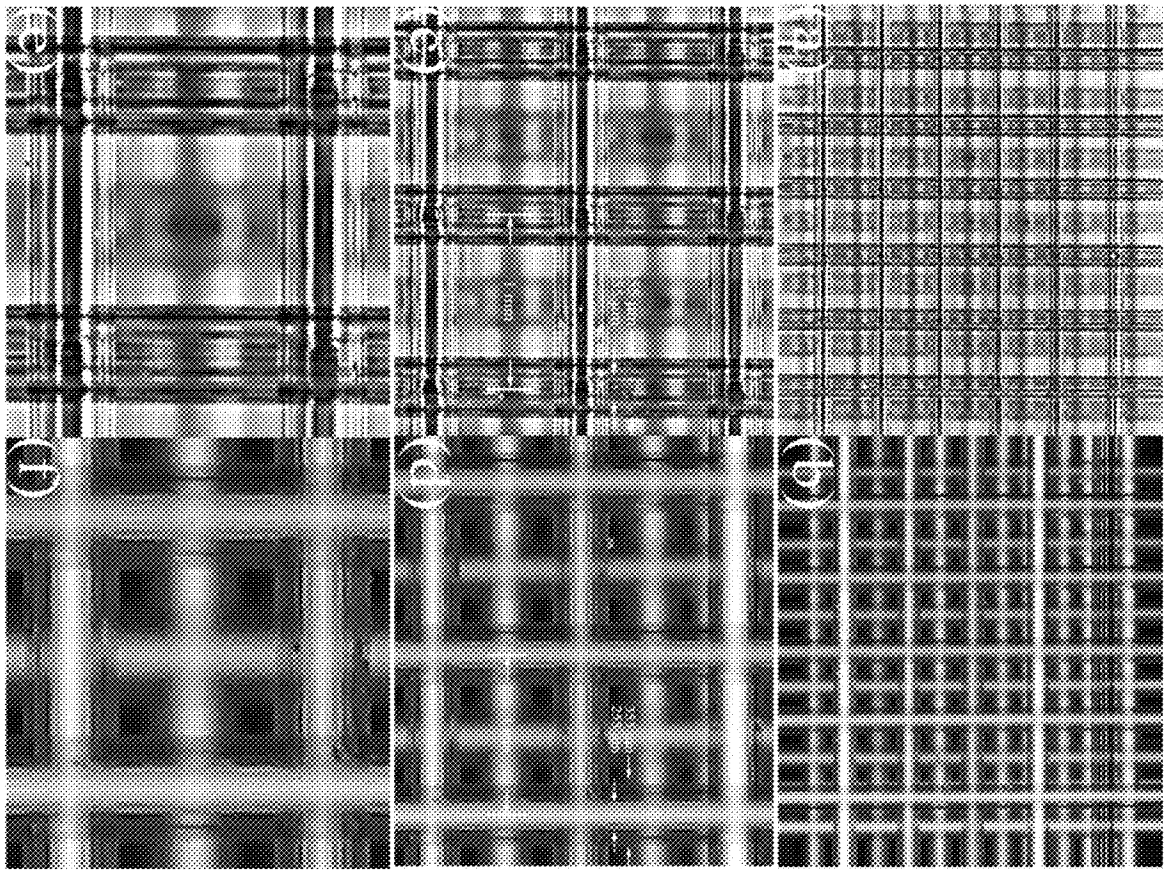
FIGS. 3A-3F are optical micrographs at different magnifications of the active area of the FIG. 2 experimental microplasma photonic crystal.

Several optical micrographs of the active area (i.e., the area to be exposed to incoming electromagnetic radiation) of the PPC of FIG. 2 are shown in FIG. 3A-3F. Images in FIGS. 3A, 3C, and 3E show the crystal prior to the generation of plasma in the microtubes at successively increasing magnifications. After the microplasmas are generated (corresponding FIGS. 3B, 3D and 3F), they are seen to be diffuse (as opposed to spatially-constricted streamers or arcs). These plasmas were produced in Ar at a pressure of ~1 atmosphere but experiments to date suggest that the pressure may be as large as several atmospheres and as low as less than 100 Torr (at 300 K, or room temperature). Also, although the highest electron densities generated to date have been produced in Ar gas (and plasma uniformity appears to be optimal), other rare gases (He, Ne, Kr, and Xe) and molecular gases such as nitrogen, air, water vapor or oxygen may be preferable in specific applications. For this experimental microplasma photonic crystal, the outer and inner diameters of the microtubes are 355 and 255 μm, respectively. The microtube pitch (center-to-center spacing) along both orthogonal coordinates in a plane is 1 mm. In the experiments, Ar gas is introduced to the microtube network and plasma is ignited by electrodes inserted into both ends of each microtube. Note also that the plasma in all of the microtubes is diffuse and spatially-uniform.

A major advantage of this microplasma photonic crystal is that the microtubes are suspended in free space by the holder, thereby allowing for metals, electromagnetic structures such as gratings, nanoparticles, nanoantennas, liquids, or other micro- and nano-devices to be placed on or between the microtubes. One example of this capability is illustrated by the modified microplasma photonic crystal that adds metal bands into a scaffold 40 of microtubes in FIGS. 4A-4C. The bands 42 of metal films are deposited onto each microtube 12 in the array. Such metal bands 42 can encompass a microtube and can be positioned periodically (or non-periodically) along the length of each tube as shown. The FIGS. 4A-4C scaffold 40 can use the holder 16 and electrodes of FIGS. 1A-1C. In the scaffold 40, the metal bands 42 themselves constitute a 3D array. FIGS. 4B-4D show this polymer tube-metal band, double crystal (comprising interlaced arrays of polymer microtubes and metal bands) from several different perspectives. It must be mentioned that such arrays of metal bands serve at least two purposes. The first of these is to provide a plasmonic response from the metal band array that interacts with the photonic response provided by the arrays of microplasmas, metal, or dielectric(s) that are positioned within the microtubes. The second is that a spatially-periodic capacitance can be provided if the microtube arrangement is designed so as to have a small gap between each of the microtubes in one planar array and those microtubes in an adjacent array. The example pattern in FIGS. 4A-4C shows the metal bands surrounding a portion of the outer surface of an array of parallel microtubes, and those bands lying directly above an array of metal bands on a second planar array of microtubes. Each pair of neighboring metal bands constitutes a capacitor, and the distance (or gap) Δ between such neighboring bands is inversely proportional to the capacitance of such capacitors. Furthermore, the capacitance of the capacitors in the arrays of FIGS. 4A-4C is a significant factor in determining the region of the electromagnetic spectrum is which the metal-band arrays produce a plasmonic response. For example, if the gap Δ is increased, the plasmonic response contributed by the metal bands can be expected to shift to higher frequencies and the reverse is true if the gap is reduced.

The microplasma photonic crystal structures of FIGS. 4A-4C have been fabricated, and FIGS. 5A-5D show several polyimide microtubes onto which metal films have been deposited. These films are thin (typically less than 50 nm in thickness) and were deposited by electron beam deposition but other film deposition processes are also acceptable. In FIGS. 5A-5D, the optical micrographs show several polyimide tubes onto which periodic gold films have been deposited by an electron beam technique. The outer diameters of the microtubes are 355 μm and, as indicated, the lengths of the gold films and their pitch (center-to-center spacing) are 400 μm and 1.0 mm, respectively. The gold films encompass each of the microtubes.

Figures 6A, 6B, 6C, 6D, 6E:
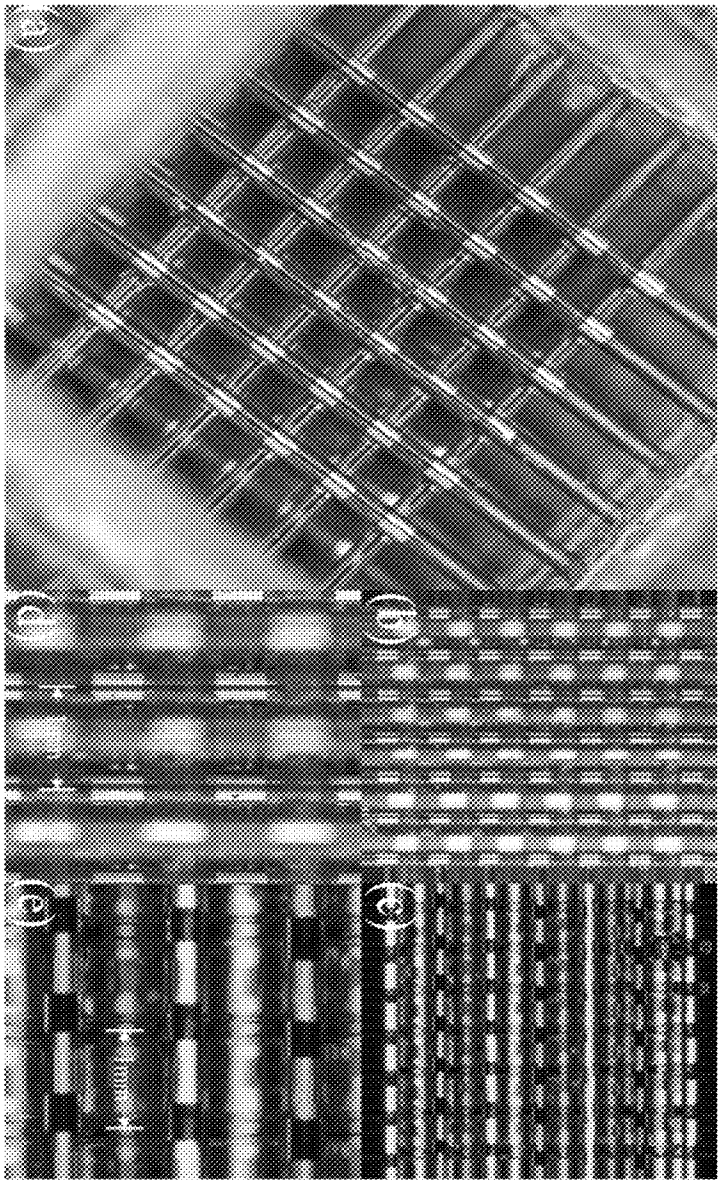
FIGS. 6A-6E are photographs of a three-dimensional microplasma photonic crystal consistent with FIGS. 4A-4D.

FIGS. 6A-6E presents several photographs of a completed array having the structure of FIGS. 4A-4D, with FIGS. 6C and 6E showing the array with plasma generated. Note that every microtube in the top layer (planar array) of the crystal has six gold bands that are positioned so as to lie directly above one tube in the next array of the crystal. One embodiment of this microplasma photonic crystal technology involves varying the gap between the lowest points on the metal bands of one set of microtubes and the upper portion of the metal bands on the lower (adjacent) set of microtubes (cf. FIG. 4D). Changing this gap alters the capacitance that couples the two sets of metal bands, thereby shifting the resonances of the crystal. Thus, the impact of the capacitance between the metal band arrays, and the plasmonic response of the band arrays, in evident in the spectral characteristics of the crystals.

To summarize, the metal bands 42 (fabricated on the microtubes in a spatially-periodic pattern) create two crystals, one of which is photonic and the other plasmonic, that are capacitively-coupled. Specifically, the structure consisting of bare polyimide tubes is one array whereas the second comprises the full set of metal bands disposed in the form of a 3D array. Because each metal band on each microtube lies directly above (or below) its counterpart on another tube, all of the metal bands in the 3D array are capacitively coupled. That is, the metal band on one tube can be designed so as to not touch the metal band on the neighboring tube(s). Therefore, each pair of neighboring metal rings constitutes a capacitor. More importantly, the two 3D arrays of FIGS. 4A-4D—the entirety of the polymer tube assembly and the entirety of the metal bands—are interwoven but electromagnetically-coupled. The metal bands introduce plasmonic resonances into the spectrum produced by the microtube crystal.

FIGS. 7-10D include spectral data of experimental devices. Before discussing the spectral data, it should be noted that the degree of capacitance between neighboring metal rings can be controlled precisely by adjusting the pitch of the microtubes. Alternatively, if one wishes to uncouple the microtube pitch from the inter-metal band capacitance, the metal bands (which are currently in the form of thin films) can be replaced by micromachined rings having the desired thickness. The smaller the gap between two neighboring rings, the larger will be the capacitance between them. Lastly, it should be mentioned that although FIGS. 5A-5D show metal band lengths of 400 μm and a band pitch of 1 mm, values of 50 μm-2 mm in length and 100 μm-650 μm in pitch, respectively, can be readily fabricated. Furthermore, the metal band structure need not have a constant pitch, even along one microtube. That is, the longitudinal spacing between metal bands (rings) can be "chirped". This is an arrangement of bands along the length of the tube in which the band spacing descends monotonically for the purpose of extending the bandwidth of selected spectral features. Ideally, the chirped spacing of the bands along one microtube should match that on other microtubes so as to strengthen (resonantly enhance) a desired spectrum.

A significant benefit of the PPC design of FIGS. 4A-4D is that electromagnetic signatures unattainable in the past are now possible. The implications of these new transmission/reflection characteristics in the mm-wave region, in particular, are quite significant for the 5G communications industry, wireless communications in general, and environmental sensing.

Figure 7:
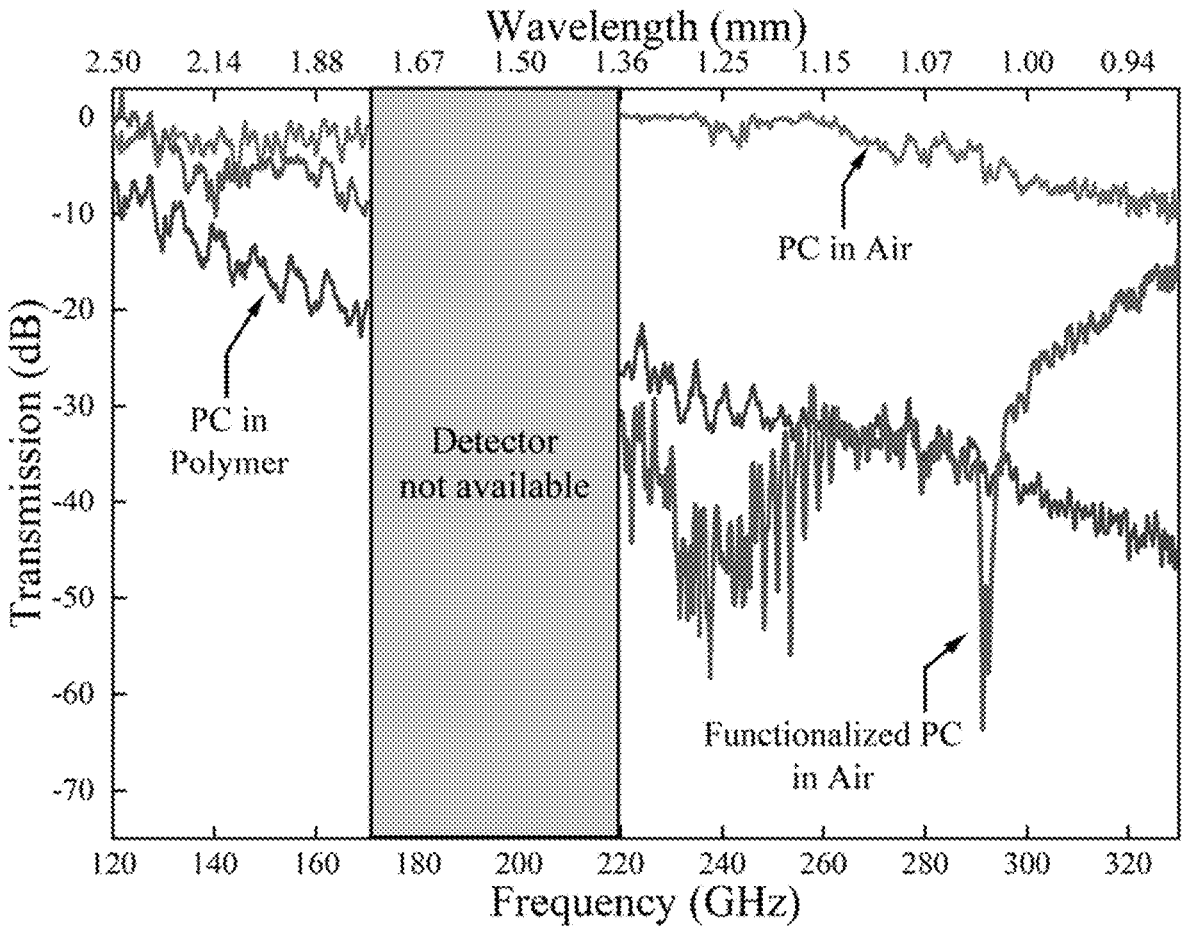
FIG. 7 shows transmission spectra obtained by impinging a tunable microwave/mm-wave signal onto the face of the experimental microplasma photonic crystals of FIG. 2 or 6A-6E (with and without metal bands), as compared to a crystal formed in a polymer block.

One example of the relevance of these crystals to communications is illustrated by the transmission spectra presented in FIG. 7 which shows spectra in the 120-170 GHz and 220-320 GHz spectral regions for several different microplasma photonic crystals. The top curve is that for the microtube array without metal bands (shown in FIG. 2) and having the configuration of FIGS. 1A-1C. The data trace of FIG. 7 showing a structured, strong attenuation band between ~220 GHz and 290 GHz demonstrates the impact of adding the metal rings of FIGS. 4A-4C and FIG. 6 to the microtube array. The third curve is that for the microcolumn array fabricated in PDMS that was disclosed in Eden et al. (U.S. Pat. No. 10,548,210). For all of the spectra shown here, no plasma was generated in any of the microtubes for the purpose of illustrating only the effect of the metal bands on the spectral characteristics of the microtube crystal. These spectra were obtained by impinging a tunable microwave/mm-wave signal onto the face of the PPCs of FIG. 2 or 6 and measuring the transmitted power as the probe frequency is scanned. These measurements were conducted over the 120-320 GHz region and (initially) without plasma generated in any of the microtubes of the crystal. Note that although it was not possible to make measurements in the 170-220 GHz interval (because of the unavailability of a detector in that spectral region), the attenuation by the microtube crystal itself (top curve) is less than 10 dB between 120 and 170 GHz and in the 220-320 GHz interval. Similarly, the insertion loss of the full microtube/metal band crystal remains under 10 dB in the 120-170 GHz spectral region. Above 220 GHz, the strong attenuation, and the resonances that appear, demonstrate that the two coupled crystals produce a bandgap that is at least 60 GHz in width. It is also clear that the upper edge of the bandgap lies near 290 GHz. These and other measurements conducted to date demonstrate that the bandgap and all spectral characteristics of these crystals can be controlled by the physical parameters of the microtube and metal band arrays. It should be emphasized that the specific metal band array described here is not optimal for many applications, but 3D simulations will provide a predictive capability for designing the details of any plasmonic array to be integrated within the microtube array. In the text to follow, the additional control afforded by the generation of microplasma in at least one of the microtubes of the scaffold 10 will be discussed.

When plasma is introduced to some or all of the microtubes of FIG. 6, startling spectral effects are observed. Specifically, the attenuation feature at 291 GHz is dramatically altered by the presence of plasma. As shown in panel FIG. 8A, the absence of plasma in the microtube/metal band scaffold (FIG. 4A, FIG. 7) is earmarked by strong attenuation peaks at 291.3 GHz and 292.5 GHz. When microplasmas are produced within the polyimide tube/metal band crystal (shown by the four curves of FIG. 8A), however, we observe that attenuation at the 291.3 GHz peak diminishes rapidly. In fact, when the microplasmas are driven by a 7.5 kV voltage waveform (labelled in FIG. 8A), the attenuation of the PPC is reduced by more than 20 dB, or more than a factor of 360 lower than that observed in the absence of plasma. In other words, the presence of plasma within the microtubes of the scaffold 10 renders the crystal much more transparent (transmissive) at 291.3 GHz. This "induced transparency", made possible by the microplasma columns, is a valuable feature for multichannel communications systems. Furthermore, the introduction of plasma into the microplasma photonic crystal affects other peaks differently. For example, the 292.5 GHz peak of FIGS. 8A and 9A shifts to higher frequencies by roughly 1.2 GHz or roughly 0.4% of 292.5 GHz. FIGS. 8B-8D provide additional detail regarding the effects of the microplasmas on crystal performance.

Specifically, FIG. 8B is the same data as FIG. 8A, but displayed as transmission spectra normalized to that for the scaffold alone (i.e., no microplasma), in order to show clearly the effect of the plasma layers. The dashed horizontal line represents the relative response of the scaffold alone. FIG. 8C illustrates frequency shifts of the 292.5 and 294.8 GHz spectral resonances as the plasma electron density is increased by raising the driving voltage. FIG. 8D includes measured transmission ratios for the 291.3 and 292.5 GHz spectral peaks.

Figures 9A, 9B, 9C, 9D:
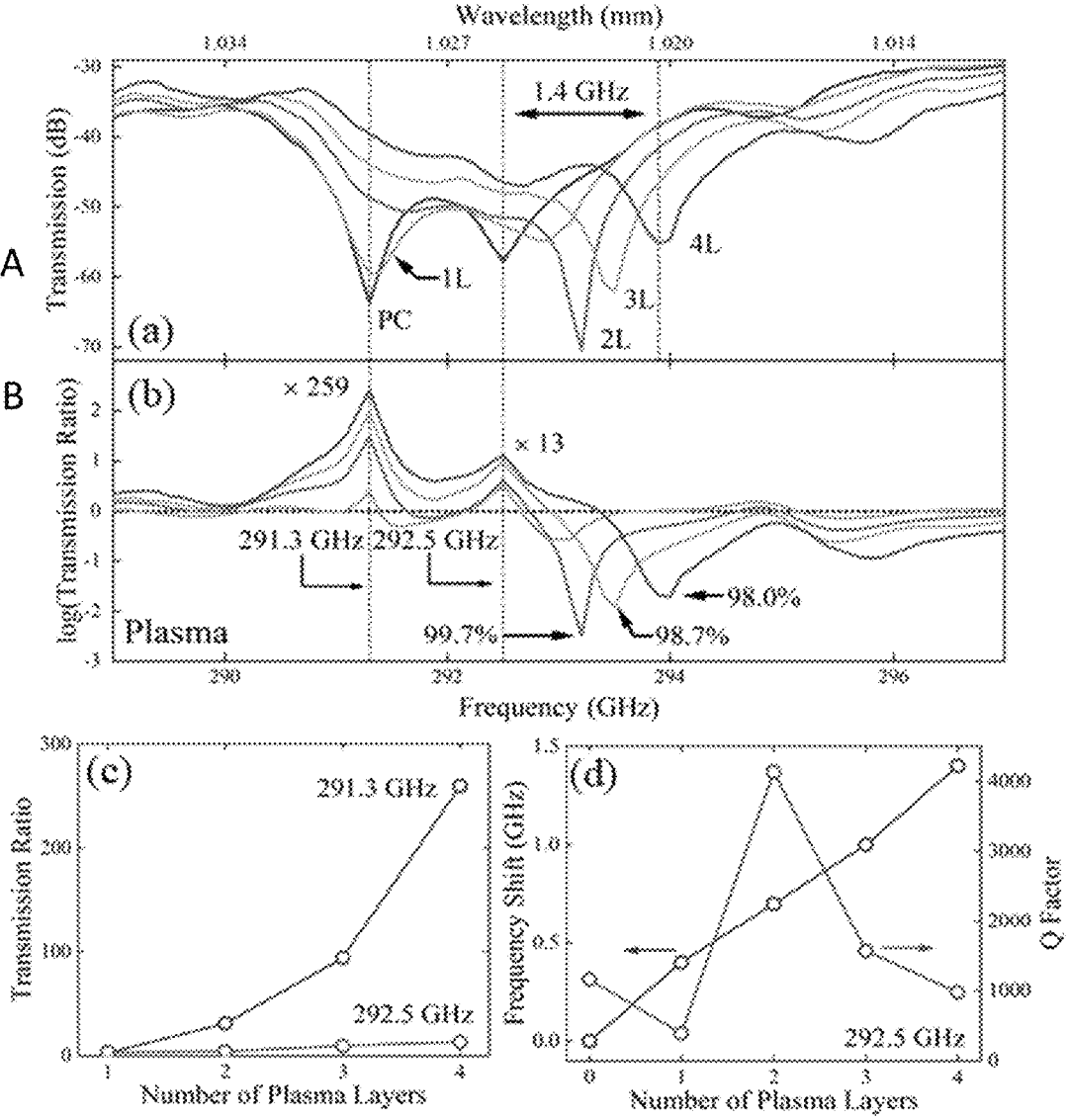
FIGS. 9A-9D include spectral data illustrating the sequential activation of microcolumn plasma layers of the experimental microtube/metal band crystals of FIG. 2 or 6A-6E.

Another significant benefit of the present PPC technology is the ability to transform the crystal quickly (at electronic speeds) by "dropping out" specific plasma columns or introducing additional ones. FIG. 9 illustrates this capability by showing the transmission spectra for the same microtube/metal band crystal of FIG. 8. For these tests, however, one layer of microplasmas was activated at a time. Only the odd-numbered layers of the crystal were excited, all of which are oriented horizontally. With the ignition of only two of the four layers (Layers #1 and #3, green curve, FIG. 9A), the attenuation resonances at 291.3 and 292.5 GHz are virtually eliminated and a new resonance has appeared at 293.5 GHz. This new resonance peak attenuates incoming signals by at least 25 dB more than that of the PPC scaffold alone at the same wavelength.

FIGS. 9A-9D show characteristics of resonances induced in polymer microtube/metal band crystals by the sequential activation of layers of microplasma columns. FIG. 9A shows spectra in the 290-296 GHz interval for the scaffold alone (i.e., microplasmas not activated; trace labeled "PC") and for one, two, three, and four layers of microplasmas (1L, 2L, 3L and 4L, respectively). FIG. 9B shows the spectra of FIG. 9A, normalized to the response of the scaffold (denoted by the dotted horizontal line). FIG. 9C shows the dependence of the transmission ratio at the 291.3 and 292.5 GHz peaks on the number of microplasma layers activated. Finally, FIG. 9D shows the variation of the frequency shift with the number of activated microplasma layers. All of these data demonstrate the control over the spectral locations of attenuation peaks, and the suppression of attenuation at specific peaks, that is available by energizing one or more layers (planar arrays) of columnar microplasmas. Experiments show that as few as one microplasma influences the spectral behavior of these crystals.

Figures 10A, 10B, 10C, 10D:
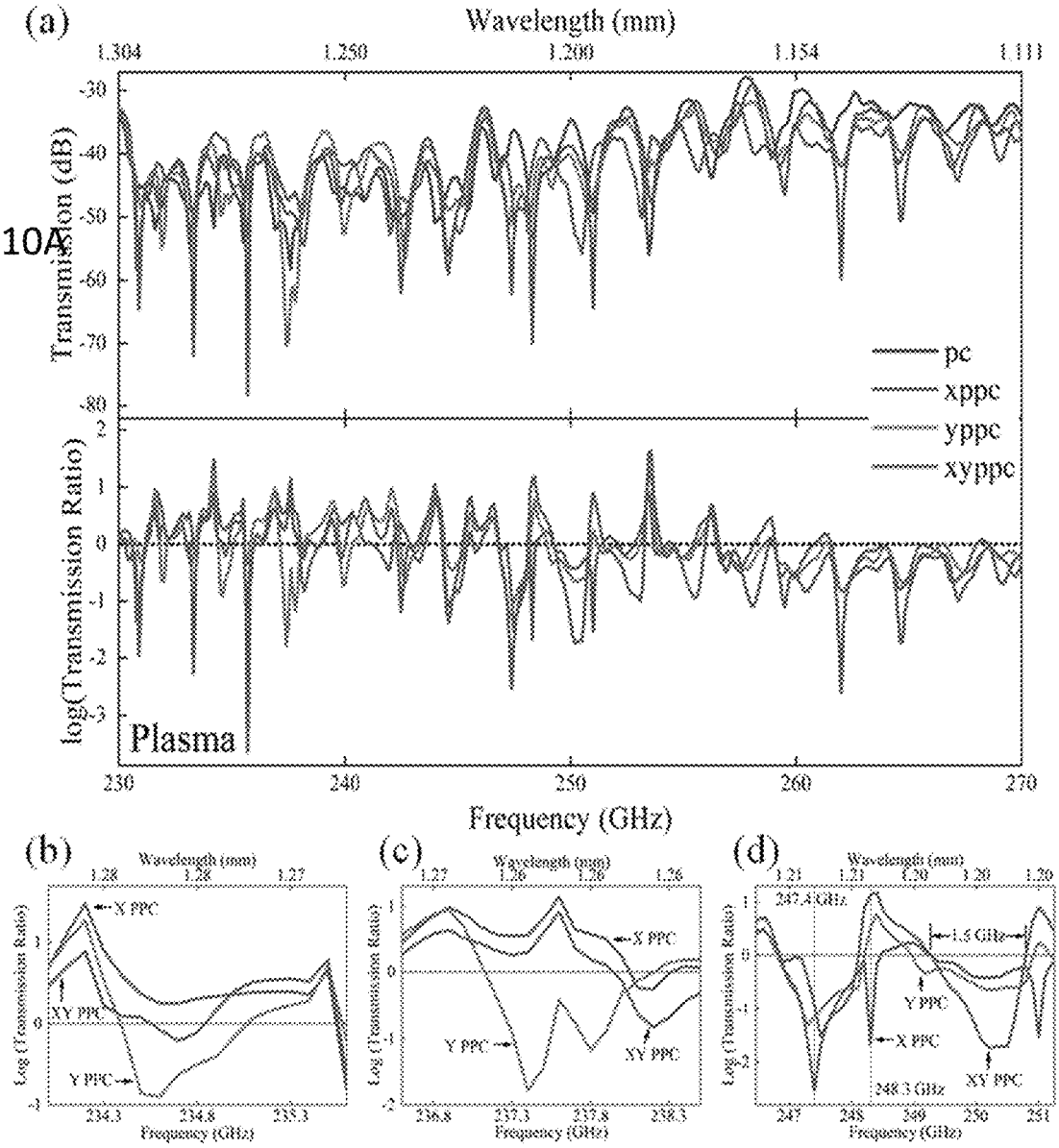
FIGS. 10A-10D show spectra in the bandgap region of FIG. 7 (230-270 GHz) for the scaffold alone (blue curve) and for different arrangements of the microplasma columns, including microplasmas only in vertically- or horizontally-oriented microtubes or combinations thereof.

Another set of experiments has shown additional control over the transmission spectrum of the microtube/metal band array crystal when several of the vertically-oriented microtubes are also filled by plasma. Specifically, the transparency of the crystal at 291.3 GHz is increased by almost 30 dB (i.e., a factor of 625) if plasma is generated in both the horizontally- and vertically-oriented layers in the woodpile structure. In essence, the attenuation resonance is cancelled because the plasma effectively shorts the resonator at that wavelength. Furthermore, in the bandgap region of FIG. 7 (230-270 GHz), the magnitude of the attenuation resonances can be manipulated by controlling the microplasmas that are activated. FIGS. 10A-10D, for example, show the influence of igniting various plasma layers on the transmission spectra of a microtube/metal band crystal having a woodpile structure. The upper half of FIG. 10A presents the raw transmission spectra in the 230-270 GHz region, whereas the lower half of FIG. 10A has normalized the experimental spectra to the response of the scaffold alone. It is evident that at ~236.5 GHz, for example, exciting plasmas in both the x- and y-oriented microtubes increases attenuation by 3.5 orders of magnitude, relative to the scaffold alone. The FIG. 10 spectra are in the bandgap region of FIG. 7 (230-270 GHz) for the scaffold alone and for various arrangements of the microplasma columns. The term "xppc" indicates that only the x-oriented (horizontal) microtubes contain plasma whereas "xyppc" indicates that plasma is produced in both the horizontally- and vertically-oriented microtubes. FIGS. 10B-10D show magnified views of particular features in the spectra and it is clear that the judicious activation of specific microplasmas, or entire planar arrays of plasma, allows one to dictate the behavior of particular resonances of the crystal. That is, attenuation may be increased, suppressed, or eliminated entirely. Also, attenuation peaks (resonances) may be shifted in frequency. Such a capability is essential for the design and implementation of high-speed wireless networks which transmit data over multiple frequency channels simultaneously. In order to maximize the data transmission rate, multiple signals are transmitted over the same frequency channel Sharing the same channel is possible only if the signals are multiplexed in time, which requires an electronic switch to alternately block and pass (transmit) signals over a given channel.

Variations of the above embodiments are possible and can yield other advantages for different applications. For example, defects can be introduced into the metal band array (lattice) by simply omitting one or more of the bands in the periodic network. Doing so alters the transmission spectrum of the crystal. Similarly, one or more microcolumn plasmas can be dropped out of any of the arrays of microplasmas that constitutes one layer (typically 6-7 microplasma columns). The advantage of dropping plasma columns is that the defect can be "repaired" electronically by re-igniting the missing plasma.

Figures 13A, 13B:
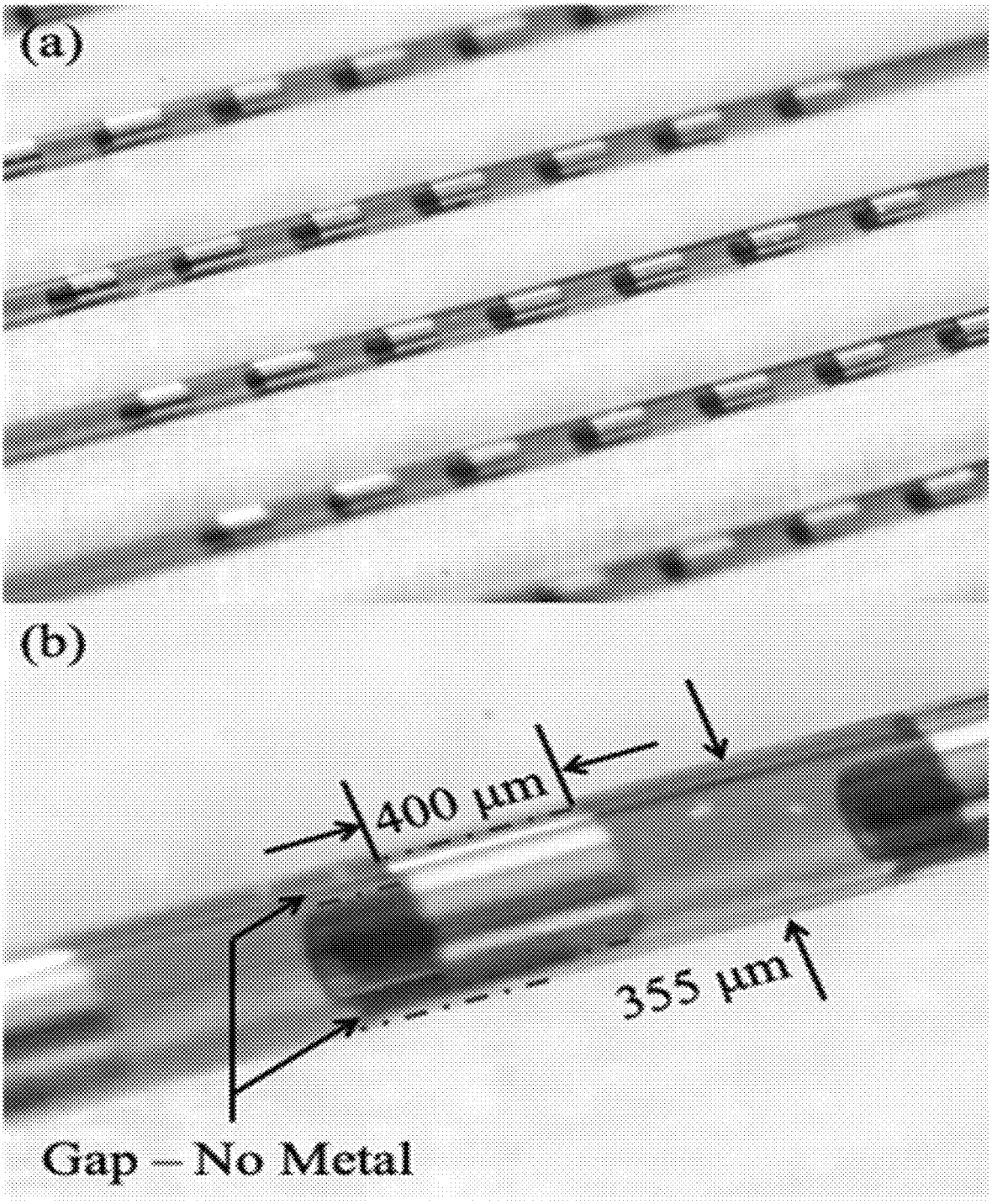
FIGS. 13A and 13B are optical micrographs at different magnifications of fabricated microtubes prior to assembly of an experimental microplasma photonic device in accordance with FIGS. 12A-12D.
Figure 14A:
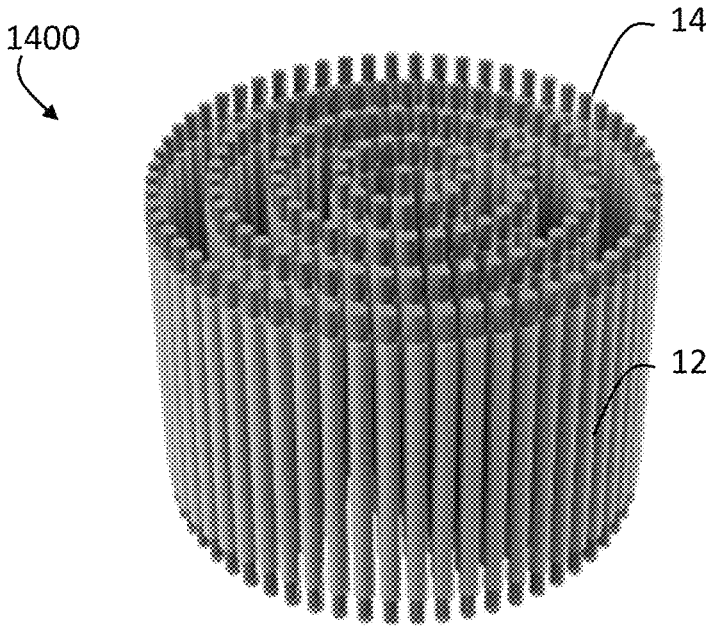
FIGS. 14A-14D are perspective scaffold, top scaffold, top holder/end cap, and side schematic views, respectively, of a preferred microtube crystal having a cylindrical geometry, including cylindrical microtube arrays of differing diameters but sharing the same axis.
Figure 14B:
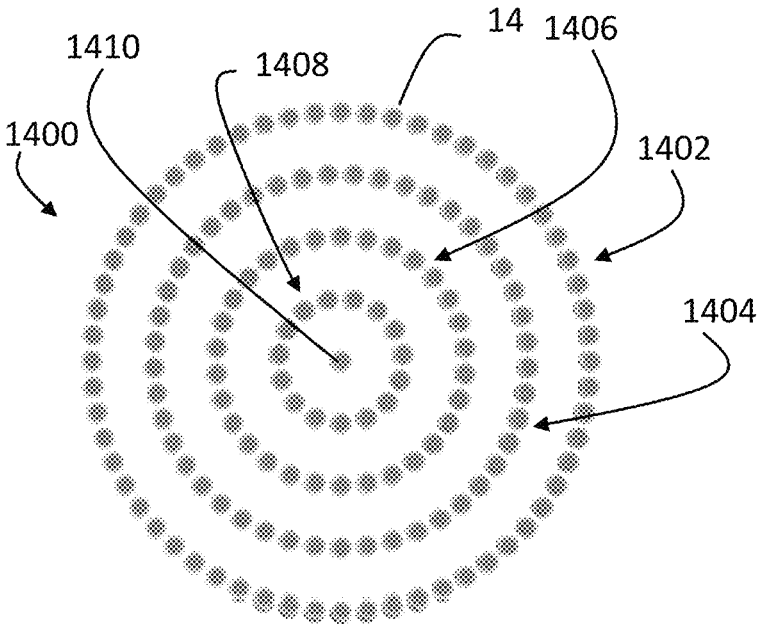
Figure 14C:
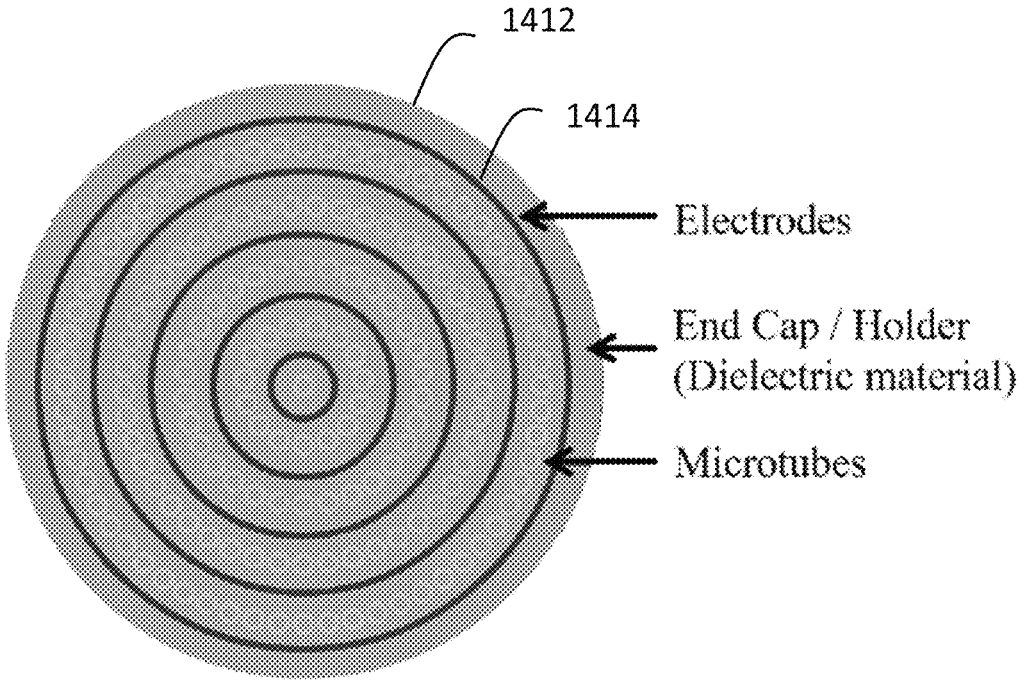
Figure 14D:
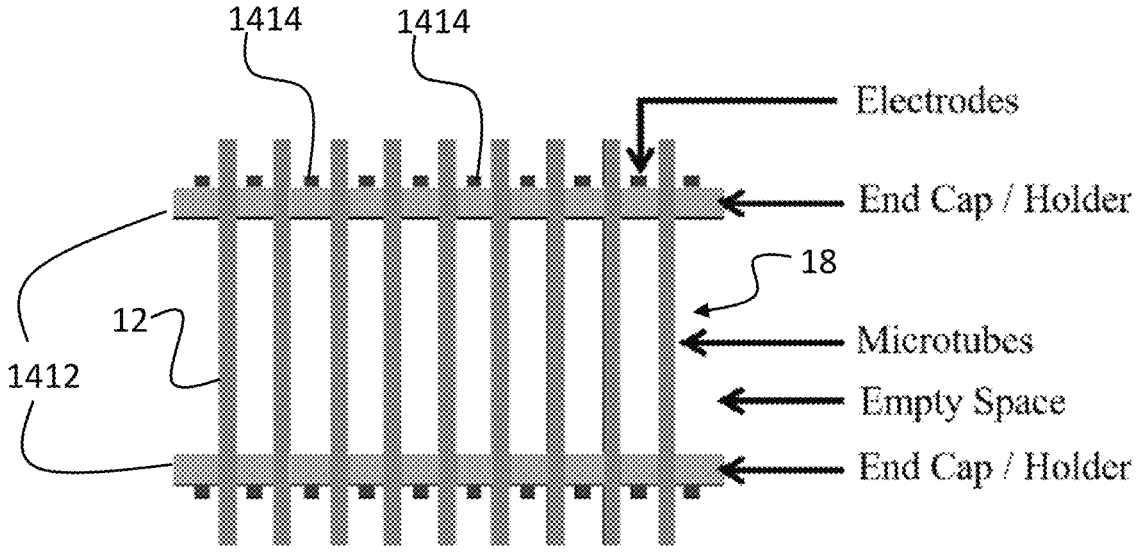

Another variation is shown in FIGS. 11A-11D. This preferred microplasma photonic crystal scaffold 1100 includes split ring resonators (SRR) 1102 at locations where the FIGS. 4A-4D embodiment includes the metal bands 42. The split ring resonators 1102 are conductors similar to the metal bands, but they do not fully extend around the microtubes so as to leave a gap 1104. Another variation is shown in FIGS. 12A-12D. This preferred microplasma photonic crystal scaffold 1200 includes double resonators 1202 at locations where the FIGS. 4A-4D embodiment includes the metal bands 42. The double resonators create two gaps 1204 around the circumference of the microtubes 12. The SRR configuration of FIGS. 11A-11D shifts the resonant frequencies of the crystal, relative to those of the metal band design of FIGS. 4A-4D, because of the gap introduced into the metal rings. Similarly, the double-resonator (or double capacitor) geometry of FIGS. 12A-12D also alters the resonant frequencies of the double crystal. Consequently, the impact of the ignition of plasma will have effects on the scaffold-only spectrum that will also differ from those of the full metal band spectra presented earlier. FIG. 13 shows two optical micrographs of polyimide tubes onto which double-resonator silver (Ag) films have been deposited.

FIG. 13 shows optical micrographs of 355 um diameter polyimide tubes onto which silver (plasmonic) films have been deposited. The films have the form of two semi-circular arcs, subtending approximately 90 degrees and facing each other, forming the double resonators of FIGS. 12A-12D. As for the other metal band geometries discussed earlier, this semi-circular configuration of the metal coatings will, in combination with the microcolumn plasma array, produce resonances differing from those of the other embodiments presented earlier. The point to be made is that the interactions between the plasmonic (metal band or resonator geometries), microplasma, and microtube arrays allows one skilled in the art considerable latitude in producing resonances at desired frequencies.

The microtube-based crystal structures need not have the woodpile geometry described earlier. Indeed, a wide variety of geometries, including other cubic-based designs will function equally well. As an example, FIGS. 14A-14D is an illustration of a plasma/metal/dielectric crystal scaffold 1400 having a cylindrical geometry. Comprising cylindrical arrays of microtubes 12 in which the arrays have different diameters but the same axis, this crystal scaffold 1400 produces different transmission spectra when probed by an electromagnetic field propagating parallel or perpendicular to the axis of the cylinders. Furthermore, a single microplasma may be placed along the axis of the cylindrical arrays to obtain a different electromagnetic response of the crystal to an incoming electromagnetic field. All electrical and gas connections to the microtube arrays are provided by narrow rings at both ends of the crystal. As illustrated in FIGS. 14A-14D, a cylindrical configuration, for example, consists of microtubes 12 arrayed in the form of thin cylinders 1402, 1404, 1406, 1408 of differing diameters but sharing the same axis of a central microtube 1410. Polymer holders in the form of an end cap 1412 (FIGS. 14C and 14D), formed by 3D printing, hold the microtubes 12 at both ends of the crystal and have the form of thin plates with embedded ring electrodes 1414 and gas channels. As with the woodpile arrangement of FIG. 1A and other quasi-cubic geometries, it may be advantageous to not fill all of the microtubes with plasma but rather fill select microtubes with metal or a dielectric. Such cylindrical crystals can be oriented such that the axis of the concentric cylinders is parallel to the incoming electromagnetic radiation or perpendicular to this axis. Different behavior will be observed with these orthogonal orientations.

Although applications of these crystals in communications in the 1 GHz-1 THz spectral region as resonators, phase shifters, attenuators, and beam splitters will be prevalent, microplasma photonic crystals are also of value for redirecting and storing energy. As one example, arrays of microplasma photonic crystals can be arranged onto a flat, hemispherical (concave), or parabolic surface. Energy delivered to this array from a small number of sources separated from the array and located, for example, at the focal point of a hemisphere, can be temporarily stored by each microplasma photonic crystal in the array. The energy will be stored on a time-scale given by the Q of an appropriate attenuation resonance of the crystal in the absence of plasma in the crystals. When plasma is generated in the crystals at the appropriate time delay with respect to the arrival of the incoming energy, the crystal will become transparent at this resonance, thereby releasing the energy stored in the crystal. If the crystal spacing in the array, activation of the crystals, and the phase characteristics of the crystal resonance are chosen properly, the array will produce a single beam of low divergence. Such an embodiment is capable of directing microwave, mm-wave, or THz energy over substantial distances with a wavefront phase profile that can be engineered.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

The invention claimed is:

1. A method of reflecting, transmitting, storing, or altering the phase of incident electromagnetic energy, the method comprising steps of:

generating a periodic array of microplasma in an array of microtubes that define a plasma photonic crystal, wherein at least plurality of the microtubes each separately confine microplasma therein, wherein the array comprises is a spacing and average electron density selected to form a photonic crystal and produce a photonic response to the incident electromagnetic energy, and wherein the microtubes of the array of microtubes are suspended within an active region of the plasma photonic crystal and the active region is free of electrodes; and interacting the incident electromagnetic energy with the periodic array of microplasma to reflect, transmit and/or trap the incident electromagnetic energy.

2. The method of claim 1, further comprising introducing a defect into the array by selectively having no microplasma generation in selected ones of the microtubes.

3. The method of claim 1, further comprising linking a second photonic crystal to the array with a periodic pattern of metal or dielectric within the array.

4. The method of claim 1, comprising storing energy in one or more periodic arrays by generating plasma in the arrays with a time delay with respect to the arrival of incoming energy to release the energy after storing it for the time delay by making the crystals transparent at the resonance of the incoming energy after the time delay.

5. The method of claim 4, wherein the energy that is released creates a single beam of low divergence.

6. A microplasma photonic crystal for reflecting, transmitting and/or storing incident electromagnetic energy, the crystal comprising:

a periodic array of elongate microtubes confining microplasma therein and that define a plasma photonic crystal, wherein the microtubes are suspended within an active region of the plasma photonic crystal and comprise a column-to-column spacing, average electron density and plasma column diameter selected to produce a photonic response to the incident electromagnetic energy entailing the increase or suppression of crystal resonances and/or shifting the frequency of the resonances; and electrodes for stimulating microplasma the elongated microtubes, wherein the electrodes are outside of the active region and the active region is free of electrodes.

7. The crystal of claim 6, wherein the microtubes are interleaved and are supported at a perimeter where the electrodes are located.

8. The crystal of claim 6, further comprising an array of metal or dielectric within the periodic array of elongate microtubes.

9. The crystal of claim 8, wherein the array of metal of dielectric comprises metal bands on microtubes and the metal bands are arranged in a periodic pattern.

10. The crystal of claim 9, comprising a defect in the periodic pattern.

11. The crystal of claim 9, wherein the periodic pattern is chirped.

12. The crystal of claim 9, wherein the metal bands comprise split ring resonators.

13. The crystal of claim 9, wherein the metal bands comprise double resonators.

14. The crystal of claim 6, wherein the microtubes are supported by a microfabricated holder for precise positioning of the microtubes.

15. The crystal of claim 14, wherein the holder comprises a computer-designed 3D stereolithography structure that supports the microtubes at end portions so as to precisely position the tubes to form a crystalline structure within an interior volume.

16. The crystal of claim 15, wherein the interior volume is in the range of less than one cubic centimeter to more than 1000 cubic centimeters.

17. The crystal of claim 14, wherein the holder positions the microtubes with a precision of +/−10 um, relative to a desired spacing between microtubes in the same array or between microtubes in an adjacent array.

18. The crystal of claim 6, wherein the microtubes are formed of a polymer.

19. The crystal of claim 6, wherein the microtubes are formed of glass, silica or thin alumina.

20. The crystal of claim 6, wherein the microtubes comprise an outer diameter in the range of 20-800 micrometers and an inner diameter in the range of 5-500 micrometers.

21. The crystal of claim 6 comprising one of magnetic fluid, such as a ferrofluid, magnetic particles, or thin discs in at least one microtube periodic array of elongate microtubes so as to magnetize the plasma generated within other microtubes.

22. The crystal of claim 6, wherein a portion, or the entirety, of the empty volume lying between the microtubes of the crystal is filled with a gas or liquid having an electromagnetic response detectable by the crystal.

* * * * *